US011999917B2

(12) United States Patent
Schwab et al.

(10) Patent No.: US 11,999,917 B2
(45) Date of Patent: Jun. 4, 2024

(54) MANNICH-BASED QUATERNARY AMMONIUM SALT FUEL ADDITIVES

(71) Applicant: Afton Chemical Corporation, Richmond, VA (US)

(72) Inventors: Scott D. Schwab, Richmond, VA (US); Geeta Vadehra, Richmond, VA (US); Michel Nuckols, Midlothian, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 17/445,926

(22) Filed: Aug. 25, 2021

(65) Prior Publication Data

US 2023/0077913 A1 Mar. 16, 2023

(51) Int. Cl.
*C10L 1/22* (2006.01)

(52) U.S. Cl.
CPC ..... *C10L 1/221* (2013.01)

(58) Field of Classification Search
CPC ..... C10L 1/221
See application file for complete search history.

(56) References Cited

U.S. PATENT DOCUMENTS

| | | | | |
|---|---|---|---|---|
| 4,171,959 | A | 10/1979 | Vartanian | |
| 4,248,719 | A | 2/1981 | Chafetz et al. | |
| 5,254,138 | A | 10/1993 | Kurek | |
| 8,083,814 | B2 | 12/2011 | Stevenson et al. | |
| 8,153,570 | B2 | 4/2012 | Barton et al. | |
| 8,529,643 | B2 | 9/2013 | Galante-Fox et al. | |
| 8,765,650 | B2 | 7/2014 | Delbridge et al. | |
| 8,894,726 | B2 | 11/2014 | Fang et al. | |
| 9,951,285 | B2 | 4/2018 | Roeger-Goepfert et al. | |
| 10,308,888 | B1 | 6/2019 | Schwab | |
| 10,689,589 | B2 | 6/2020 | Cook | |
| 2007/0169408 | A1* | 7/2007 | Hou | C10L 1/143 44/415 |
| 2008/0274924 | A1* | 11/2008 | Lange | C10L 1/221 525/138 |
| 2012/0138004 | A1 | 6/2012 | Stevenson et al. | |
| 2013/0031828 | A1* | 2/2013 | Reid | C10L 10/04 44/386 |
| 2013/0104826 | A1 | 5/2013 | Burgess et al. | |
| 2013/0118062 | A1* | 5/2013 | Fang | C10L 1/2225 44/422 |
| 2014/0157656 | A1 | 6/2014 | Reid | |
| 2014/0174390 | A1 | 6/2014 | Reid et al. | |
| 2015/0252278 | A1 | 9/2015 | Bush et al. | |
| 2016/0046855 | A1 | 2/2016 | Mastrangelo et al. | |
| 2016/0130514 | A1 | 5/2016 | Hansch et al. | |
| 2016/0152910 | A1 | 6/2016 | Reid et al. | |
| 2016/0152912 | A1 | 6/2016 | Mulqueen | |
| 2017/0096610 | A1 | 4/2017 | Bush et al. | |
| 2017/0096611 | A1 | 4/2017 | Stevenson et al. | |
| 2017/0101594 | A1 | 4/2017 | Stevenson et al. | |
| 2017/0107438 | A1 | 4/2017 | Greenfield et al. | |
| 2017/0114296 | A1 | 4/2017 | Arters et al. | |
| 2017/0114297 | A1 | 4/2017 | Sampler et al. | |
| 2017/0121628 | A1 | 5/2017 | Moreton et al. | |
| 2017/0166826 | A1 | 6/2017 | Culley et al. | |
| 2017/0218291 | A1 | 8/2017 | Reid et al. | |
| 2018/0066202 | A1 | 3/2018 | Gahagan et al. | |
| 2018/0223203 | A1 | 8/2018 | Cook | |
| 2021/0115347 | A1 | 4/2021 | Mulqueen et al. | |

FOREIGN PATENT DOCUMENTS

| | | | |
|---|---|---|---|
| EP | 2531580 | A1 | 12/2012 |
| EP | 2739707 | A1 | 6/2014 |
| WO | 2020058672 | A1 | 3/2020 |

OTHER PUBLICATIONS

Shanahan, Charles S. et al. "A General Method for Fouling Injectors in Gasoline Direct Injection Vehicles and the Effects fo Deposits on VehiclePerformance," SAE Int. J. Fuels Lubr. 10(3):2017, doi: 10.4271/2017-01-2298.

European Search Report, Application No. 22190943.5 published on Jan. 26, 2023.

* cited by examiner

*Primary Examiner* — Latosha Hines
(74) *Attorney, Agent, or Firm* — Honigman LLP

(57) ABSTRACT

The present disclosure provides fuel additives including Mannich-based quaternary ammonium salt additives, fuel compositions including such additives, and Methods of improving performance of fuel injector using such additives.

20 Claims, No Drawings

MANNICH-BASED QUATERNARY AMMONIUM SALT FUEL ADDITIVES

TECHNICAL FIELD

This disclosure is directed to fuel additive compositions that include Mannich-based quaternary ammonium salts, fuels including such additives, and to methods for using such salts in a fuel composition as fuel detergents.

BACKGROUND

Fuel compositions for vehicles are continually being improved to enhance various properties of the fuels in order to accommodate their use in newer, more advanced engines. Often, improvements in fuel compositions center around improved fuel additives and other components used in the fuel. For example, friction modifiers may be added to fuel to reduce friction and wear in the fuel delivery systems of an engine. Other additives may be included to reduce the corrosion potential of the fuel or to improve the conductivity properties. Still other additives may be blended with the fuel to improve fuel economy. Engine and fuel delivery system deposits represent another concern with modern combustion engines, and therefore other fuel additives often include various deposit control additives to control and/or mitigate engine deposit problems. Thus, fuel compositions typically include a complex mixture of additives.

However, there remain challenges when attempting to balance such a complex assortment of additives. For example, some of the conventional fuel additives may be beneficial for one characteristic, but at the same time be detrimental to another characteristic of the fuel. Other fuel additives often require an unreasonably high treat rate to achieve their desired effect, which tends to place undesirable limits on the available amounts of other additives in the fuel composition.

Quaternary ammonium compounds, such as alkoxylated salts, have recently been developed as detergents for fuels. The quaternary ammonium compounds, in some instances, are obtained from an acylating agent reacted with a polyamine, which is then alkylated or quaternized by a quaternizing agent. Polyisobutenyl succinimide (PIBSI)-derived quaternary ammonium salt detergents are one type of such compound commonly used to promote improved engine operation, such as, increased fuel economy, better vehicle drivability, reduced emissions and less engine maintenance by reducing, minimizing and controlling deposit formation. Such quaternized detergents are typically derived from PIBSI compounds that have pendant tertiary amine sites that can be alkylated, or quaternized, by hydrocarbyl epoxides, such as propylene oxide.

While providing improved detergency compared to prior detergents, these quaternary ammonium compounds and their methods of alkylation, however, still have several shortcomings. For instance, quaternary ammonium salts detergents often require the use of flammable and undesired epoxides, such as ethylene oxide propylene oxide, and/or require the use of specialized and expensive pressure vessels for their production. Such oxides, however, are often undesired due to their handling difficulties. In other instances, the alkoxylation step requires a carboxylic acid as proton donor. The resulting carboxylate may lead to deposit formation and other issues related to carboxylate salts being present in the additive and fuel. In other instances, the polyisobutenyl succinamide and/or ester intermediates tend to be viscous and/or difficult to handle during the manufacturing process.

The reaction products often contain varying amounts of polyisobutenyl succinimides rendering it difficult to charge a correct amount of epoxide and/or acid to the reaction mixture. In other instances, quaternary ammonium compounds may be formed through alkylation using dialkyl carbonates. However, the carbonate anion may be susceptible to precipitation and drop out of certain types of fuels or fuel additive packages. Thus, prior quaternary ammonium compounds may have various shortcomings in their manufacture and/or application.

SUMMARY

In one aspect, a quaternary ammonium salt fuel additive is described herein. In one approach or embodiment, the quaternary ammonium salt fuel additive has the structure of Formula I (Formula I)

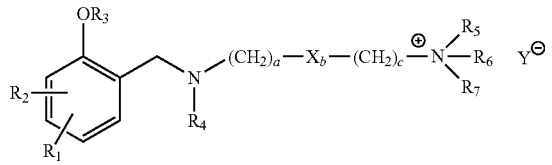

wherein $R_1$ is a hydrocarbyl radical, wherein the number average molecular weight of the hydrocarbyl is about 200 to about 5,000; $R_2$ is hydrogen or a $C_1$-$C_6$ alkyl group; $R_3$ is hydrogen or, together with $R_4$, a —C(O)— group or a —$CH_2$— group forming a ring structure with the nitrogen atom closest to the aromatic ring; $R_4$ is one of hydrogen, $C_1$-$C_6$ alkyl, —$(CH_2)_a$—$NR_5R_6$, —$(CH_2)_a$-Aryl($R_1$)($R_2$)($OR_3$), or together with $R_3$, a —C(O)— group or a —$CH_2$— group forming a ring structure with the nitrogen atom closest to the aromatic ring; $R_5$ is $C_1$-$C_6$ alkyl or, together with $Y^{\ominus}$, forms a $C_1$-$C_6$ alkyl substituted —C(O)$O^{\ominus}$; $R_6$ and $R_7$, independently, are $C_1$-$C_6$ alkyl; a is an integer from 1 to 10, b is an integer selected from either 0 or 1, and c is an integer from 0 to 10; X is oxygen or nitrogen; and $Y^{\ominus}$ is an anionic group having a structure $R_8C(O)O^{\ominus}$ wherein $R_8$ is one of (i) together with $R_5$ a $C_1$-$C_6$ alkyl group or (ii) a $C_1$-$C_6$ alkyl, an aryl, a $C_1$-$C_4$ alklylene-C(O)O—$R_2$ or a —C(O)O—$R_2$ group.

In other approaches or embodiments, the additive of the previous paragraph may be combined with other features, embodiments, or approaches in any combination. Such embodiments may include one or more of: wherein $R_1$ is a hydrocarbyl radical derived from a polyisobutylene polymer or oligomer, the number average molecular weight being about 500 to about 1,500, $R_2$ is hydrogen or a methyl group, $R_3$ and $R_4$ are each hydrogen; a is an integer from 1 to 4, and b and c are each 0; and/or wherein $R_5$, $R_6$, and $R_7$ are each $C_1$-$C_6$ alkyl and wherein $Y^{\ominus}$ is the anionic group having the structure $R_8C(O)O^{\ominus}$ with $R_8$ being the $C_1$-$C_6$ alkyl, an aryl, a $C_1$-$C_4$ alklylene-C(O)O—$R_2$ or a —C(O)O—$R_2$ group; and/or wherein $R_1$ is a hydrocarbyl radical derived from a polyisobutylene polymer or oligomer; $R_2$ is hydrogen or a methyl group, the number average molecular weight being about 500 to about 1,500, $R_3$ together with $R_4$ is the —C(O)— group or the —$CH_2$— group forming a ring structure with the nitrogen atom closest to the aromatic ring; a is an integer from 1 to 4, b and c are each 0; and/or wherein and $R_5$, $R_6$, and $R_7$ are each $C_1$-$C_6$ alkyl and wherein $Y^{\ominus}$ is the anionic group having the structure $R_8C(O)O^{\ominus}$ with $R_8$ being the $C_1$-$C_6$ alkyl, an aryl, a $C_1$-$C_4$ alklylene-C(O)O—$R_2$ or a —C(O)O—$R_2$ group; and/or wherein $R_1$ is a hydrocarbyl radical derived from a polyisobutylene polymer or oligomer, the number average molecular weight being about 500 to about 1,500, $R_2$ is hydrogen or a methyl group, $R_3$ is hydrogen, $R_4$ is the $C_1$-$C_6$ alkyl group, the —$(CH_2)_a$—$NR_5R_6$ group, or the —$(CH_2)_a$-Aryl$R_1R_2OR_3$ group, a is an integer from 1 to 4, b and c are each 0; and/or wherein and $R_5$, $R_6$, and $R_7$ are each $C_1$-$C_6$ alkyl and wherein $Y^{\ominus}$ is the anionic group having the structure $R_8C(O)O^{\ominus}$ with $R_8$ being the $C_1$-$C_6$ alkyl, an aryl, a $C_1$-$C_4$ alklylene-C(O)O—$R_2$ or a —C(O)O—$R_2$ group; and/or wherein $R_1$ is a hydrocarbyl radical derived from a polyisobutylene polymer or oligomer, the number average molecular weight being about 500 to about 1,500, $R_2$ is hydrogen or a methyl group, $R_3$ and $R_4$ are each hydrogen; a is an integer from 1 to 4, b is 1, c is an integer from 1 to 4, and X is nitrogen or oxygen; and/or wherein and $R_5$, $R_6$, and $R_7$ are each $C_1$-$C_6$ alkyl and wherein $Y^{\ominus}$ is the anionic group having the structure $R_8C(O)O^{\ominus}$ with $R_8$ being the $C_1$-$C_6$ alkyl, an aryl, a $C_1$-$C_4$ alklylene-C(O)O—$R_2$ or a —C(O)O—$R_2$ group; and/or wherein the quaternary ammonium salt fuel additive is derived from (i) a Mannich reaction product or derivative thereof having at least one tertiary amino group and prepared from a hydrocarbyl-substituted phenol, cresol, or derivative thereof, an aldehyde, and a hydrocarbyl polyamine providing the tertiary amino group and reacted with (ii) a quaternizing agent selected from the group consisting of a carboxylic or polycarboxylic acid, ester, amide, or salt thereof or halogen substituted derivative thereof; and/or wherein the hydrocarbyl polyamine has the structure $R_9R_{10}N$—$[CH_2]_a$—$X_b$—$[CH_2]_c$—$NR_9R_{10}$ wherein $R_9$ and $R_{10}$ are independently a hydrogen or a $C_1$ to $C_6$ alkyl group with one $R_9$ and $R_{10}$ pair forming a tertiary amine, X is oxygen or nitrogen, a is an integer from 1 to 10, b is an integer of 0 or 1, and c is an integer from 0 to 10; and/or wherein the quaternizing agent is a diester of a polycarboxylic acid; and/or wherein the quaternizing agent is a diester of oxalic acid, phthalic acid, maleic acid, or malonic acid, or combinations thereof; and/or wherein the quaternizing agent is a halogen substituted derivative of a carboxylic acid; and/or wherein the halogen substituted derivative of a carboxylic acid is a mono-, di-, or tri-chloro-bromo-, fluoro-, or iodo-carboxylic acid, ester, amide, or salt thereof selected from the group consisting of halogen-substituted acetic acid, propanoic acid, butanoic acid, isopropanoic acid, isobutanoic acid, tert-butanoic acid, pentanoic acid, heptanoic acid, octanoic acid, halo-methyl benzoic acid, and isomers, esters, amides, and salts thereof; and/or wherein the quaternary ammonium salt fuel additive is an internal salt substantially devoid of free anion species.

In another approach or embodiment, a fuel composition comprising a major amount of fuel and a minor amount of a quaternary ammonium salt having the structure of Formula I is described herein. In embodiments, the structure of Formula is as follows:

(Formula I)

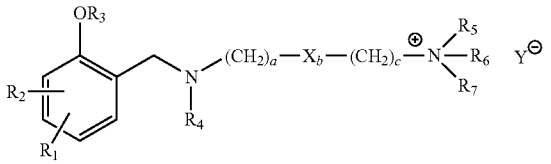

wherein $R_1$ is a hydrocarbyl radical, wherein the number average molecular weight of the hydrocarbyl is about 200 to about 5,000; $R_2$ is hydrogen or $C_1$-$C_6$ alkyl; $R_3$ is hydrogen or, together with $R_4$, a —C(O)— group or a —$CH_2$— group forming a ring structure with the nitrogen atom closest to the aromatic ring; $R_4$ is one of hydrogen, $C_1$-$C_6$ alkyl, —$(CH_2)_a$—$NR_5R_6$, —$(CH_2)_a$-Aryl$R_1R_2OR_3$, or together with $R_3$, a —C(O)— group or a —$CH_2$— group forming a ring structure with the nitrogen atom closest to the aromatic ring; $R_5$ is $C_1$-$C_6$ alkyl or, together with $Y^{\ominus}$, forms a $C_1$-$C_6$ alkyl substituted —$C(O)O^{\ominus}$; $R_6$ and $R_7$, independently, are $C_1$-$C_6$ alkyl; a is an integer from 1 to 10, b is an integer selected from either 0 or 1, and c is an integer from 0 to 10; X is oxygen or nitrogen; and $Y^{\ominus}$ is an anionic group having a structure $R_8C(O)O^{\ominus}$ wherein $R_8$ is one of (i) together with $R_5$ a $C_1$-$C_6$ alkyl group or (ii) a $C_1$-$C_6$ alkyl, an aryl, a $C_1$-$C_4$ alklylene-C(O)O—$R_2$ or a —C(O)O—$R_2$ group.

In other approaches or embodiments, the fuel composition of the previous paragraph may be combined with other features, embodiments, or approaches in any combination. Such embodiments may include one or more of: wherein $R_1$ is a hydrocarbyl radical derived from a polyisobutylene polymer or oligomer, the number average molecular weight being about 500 to about 1,500, $R_2$ is hydrogen or a methyl group, $R_3$ and $R_4$ are each hydrogen; a is an integer from 1 to 4, and b and c are each 0; and/or wherein $R_5$, $R_6$, and $R_7$ are each $C_1$-$C_6$ alkyl and wherein $Y^{\ominus}$ is the anionic group having the structure $R_8C(O)O^{\ominus}$ with $R_8$ being the $C_1$-$C_6$ alkyl, an aryl, a $C_1$-$C_4$ alklylene-C(O)O—$R_2$ or a —C(O)O—$R_2$ group; and/or wherein $R_1$ is a hydrocarbyl radical derived from a polyisobutylene polymer or oligomer, the number average molecular weight being about 500 to about 1,500, $R_2$ is hydrogen or a methyl group; $R_3$ together with $R_4$ is the —C(O)— group or the —$CH_2$— group forming a ring structure with the nitrogen atom closest to the aromatic ring; a is an integer from 1 to 4, b and c are each 0; and/or wherein and $R_5$, $R_6$, and $R_7$ are each $C_1$-$C_6$ alkyl and wherein $Y^{\ominus}$ is the anionic group having the structure $R_8C(O)O^{\ominus}$ with $R_8$ being the $C_1$-$C_6$ alkyl, an aryl, a $C_1$-$C_4$ alklylene-C(O)O—$R_2$ or a —C(O)O—$R_2$ group; and/or wherein $R_1$ is a hydrocarbyl radical derived from a polyisobutylene polymer or oligomer, the number average molecular weight being about 500 to about 1,500, $R_2$ is hydrogen or a methyl group, $R_3$ is hydrogen, $R_4$ is the $C_1$-$C_6$ alkyl group, the —$(CH_2)_a$—$NR_5R_6$ group, or the —$(CH_2)_a$-Aryl$R_1R_2OR_3$ group, a is an integer from 1 to 4, b and c are each 0; and/or wherein and $R_5$, $R_6$, and $R_7$ are each $C_1$-$C_6$ alkyl and wherein $Y^{\ominus}$ is the anionic group having the structure $R_8C(O)O^{\ominus}$ with $R_8$ being the $C_1$-$C_6$ alkyl, an aryl, a $C_1$-$C_4$ alklylene-C(O)O—$R_2$ or a —C(O)O—$R_2$ group; and/or wherein $R_1$ is a hydrocarbyl radical derived from a polyisobutylene polymer or oligomer, the number average molecular weight being about 500 to about 1,500, $R_2$ is hydrogen or a methyl group, $R_3$ and $R_4$ are each hydrogen; a is an integer from 1 to 4, b is 1, c is an integer from 1 to 4, and X is nitrogen or oxygen; and/or wherein and $R_5$, $R_6$, and $R_7$ are each $C_1$-$C_6$ alkyl and wherein $Y^{\ominus}$ is the anionic group having the structure $R_8C(O)O^{\ominus}$ with $R_8$ being the $C_1$-$C_6$ alkyl, an aryl, a $C_1$-$C_4$ alklylene-C(O)O—$R_2$ or a —C(O)O—$R_2$ group; and/or wherein the fuel is selected from diesel or gasoline; and/or wherein the fuel is diesel and includes about 20 to about 200 ppm of the quaternary ammonium salt; and/or wherein the fuel is gasoline and includes about 5 to about 20 ppm of the quaternary ammonium salt; and/or wherein the quaternary ammonium salt is derived from (i) a Mannich reaction product or derivative thereof having at least one tertiary amino group and prepared from a hydrocarbyl-substituted phenol, cresol, or derivative thereof, an aldehyde, and a hydrocarbyl polyamine providing the tertiary amino group and reacted with (ii) a quaternizing agent selected from the group consisting of a carboxylic or polycarboxylic acid, ester, amide, or salt thereof or halogen substituted derivative thereof; and/or wherein the hydrocarbyl polyamine has the structure $R_9R_{10}N—[CH_2]_a—X_b—[CH_2]_c—NR_9R_{10}$ wherein $R_9$ and $R_{10}$ are independently a hydrogen or a $C_1$ to $C_6$ alkyl group with one $R_9$ and $R_{10}$ pair forming a tertiary amine, X is oxygen or nitrogen, a is an integer from 1 to 10, b is an integer of 0 or 1, and c is an integer from 0 to 10; and/or wherein the quaternizing agent is a diester of a polycarboxylic acid; and/or wherein the quaternizing agent is a diester of oxalic acid, phthalic acid, maleic acid, or malonic acid, or combinations thereof; and/or wherein the quaternizing agent is a halogen substituted derivative of a carboxylic acid; and/or wherein the halogen substituted derivative of a carboxylic acid is a mono-, di-, or tri-chloro-bromo-, fluoro-, or iodo-carboxylic acid, ester, amide, or salt thereof selected from the group consisting of halogen-substituted acetic acid, propanoic acid, butanoic acid, isopropanoic acid, isobutanoic acid, tert-butanoic acid, pentanoic acid, heptanoic acid, octanoic acid, halo-methyl benzoic acid, and isomers, esters, amides, and salts thereof; and/or wherein the quaternary ammonium salt fuel additive is an internal salt substantially devoid of free anion species.

In yet further embodiments, the present disclosure provides the use of the fuel additive or the fuel composition of any embodiment of this Summary to provide for improved engine performance, such as a power recovery of about 5 percent or great, about 10 percent or greater or about 40 percent or greater as measured by a CED F-98-08 test modified.

DETAILED DESCRIPTION

The present disclosure provides fuel additives including a Mannich-based quaternary ammonium salt formed by reacting an alkylating or quaternizing agent with a Mannich-based tertiary amine. Also provided herein are fuel compositions including the novel fuel additives and methods of using or combusting a fuel including the fuel additives herein. The unique Mannich-based quaternary ammonium salts herein are beneficial because they can be made through a simple alkylation process, surprisingly achieve a high degree of quaternization, and provide improved detergency at low treat rates by making available, in some instances, a secondary nitrogen as well as a quaternized nitrogen.

In one aspect of this disclosure, an exemplary fuel additive including a Mannich-based quaternary ammonium salt compound has the structure of Formula Ia (Formula Ia)

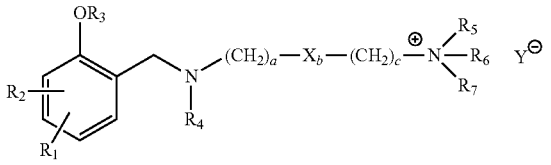

wherein $R_1$ is a hydrocarbyl radical where a number average molecular weight of the hydrocarbyl is about 200 to about 5,000; $R_2$ is hydrogen or a $C_1$-$C_6$ alkyl group; $R_3$ is hydrogen or, together with $R_4$, a —C(O)— group or a —$CH_2$— group forming a ring structure with the nitrogen atom closest to the aromatic ring; $R_4$ is one of hydrogen, $C_1$-$C_6$ alkyl, $—(CH_2)_a—NR_5R_6$, $—(CH_2)_a$-Aryl($R_1$)($R_2$)($OR_3$), or together with $R_3$, a —C(O)— group or a —$CH_2$— group forming a ring structure with the nitrogen atom closest to the aromatic ring; $R_5$, is $C_1$-$C_6$ alkyl or, together with $Y^{\ominus}$, forms a $C_1$-$C_6$ alkyl substituted $—C(O)O^{\ominus}$; $R_6$ and $R_7$, independently, are $C_1$-$C_6$ alkyl; a is an integer from 1 to 10, b is an integer selected from either 0 or 1, and c is an integer from 0 to 10; X is oxygen or nitrogen; and $Y^{\ominus}$ is an anionic group having a structure $R_8C(O)O^{\ominus}$ wherein $R_8$ is one of (i) together with $R_5$ a C1-C6 alkyl group or (ii) an alkyl, an aryl, or a $—C(O)O—R_2$ group.

In yet another aspect of this disclosure, an exemplary fuel additive including a Mannich-based quaternary ammonium salt compound has the structure of Formula Ib (Formula Ib)

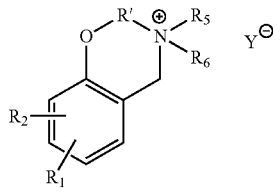

wherein R' is a C1 to C4 alkyl and $R_1$, $R_2$, $R_5$, $R_6$ and $Y^{\ominus}$ are as defined above.

In yet another embodiment, a method of operating a fuel injected engine to provide improved engine performance is described. The method includes combusting in the engine a fuel composition including a major amount of fuel and about 5 to about 500 ppm of a Mannich-based quaternary ammonium salt having the structure of Formula Ia or Ib. In the context of gasoline, the fuel may include about 5 to about 50 ppm of the Mannich-based quaternary ammonium salt. In the context of diesel, the fuel may include about 20 to about 300 ppm of the Mannich-based quaternary ammonium salt. In yet further aspects, a use of the Mannich-based quaternary ammonium salts of Formula Ia or Ib is provided to provide improved engine performance such as a power recovery of about 5 percent or greater, about 10 percent or greater, or about 40 percent or greater, as measured by a CEC F-98-08 test modified to evaluate the ability of an additive to restore power lost due to deposit formation, and/or removal of deposits and/or unsticking injectors on a cold start. Details on the CEC F-98-08 test are provided in the Examples herein.

As used herein, the term "hydrocarbyl group" or "hydrocarbyl" or "hydrocarbyl substituent" is used in its ordinary sense, which is well-known to those skilled in the art. Specifically, it refers to a group having a carbon atom directly attached to the remainder of a molecule and having a predominantly hydrocarbon character. Examples of hydrocarbyl groups include: (1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical); (2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, amino, alkylamino, and sulfoxy); (3) hetero-substituents, that is, substituents which, while having a predominantly hydrocarbon character, in the context of this description, contain other than carbon in a ring or chain otherwise composed of carbon atoms. Heteroatoms include sulfur, oxygen, nitrogen, and encompass substituents such as pyridyl, furyl, thienyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein, the term "major amount" is understood to mean an amount greater than or equal to 50 weight percent, for example about 80 weight percent to about 98 weight percent relative to the total weight of the composition. Moreover, as used herein, the term "minor amount" is understood to mean an amount less than 50 weight percent relative to the total weight of the composition.

As used herein, the term "percent by weight", unless expressly stated otherwise, means the percentage the recited component represents to the weight of the entire composition. As also used herein, the term "ppm," unless otherwise indicated, is the same as "ppmw," which means parts per million by weight or mass.

Unless stated otherwise, the term "alkyl" as employed herein refers to straight, branched, cyclic, and/or substituted saturated chain moieties of from about 1 to about 100 carbon atoms. The term "alkenyl" as employed herein refers to straight, branched, cyclic, and/or substituted unsaturated chain moieties of from about 3 to about 10 carbon atoms. The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, oxygen, and sulfur.

The number average molecular weight for any embodiment herein may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5μ, and pore size ranging from 100-10000 Å) with the column temperature at about 40° C. Un-stabilized HPLC grade tetrahydrofuran (THF) may be used as solvent, at a flow rate of 1.0 mL/min. The GPC instrument may be calibrated with commercially available polystyrene (PS) standards having a narrow molecular weight distribution ranging from 500 to 380,000 g/mol. The calibration curve can be extrapolated for samples having a mass less than 500 g/mol. Samples and PS standards can be in dissolved in THF and prepared at concentration of 0.1 to 0.5 wt. % and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

The Mannich-based quaternary salt additives herein are derived from Mannich reaction products having at least a terminal tertiary amine. The Mannich reaction products may be obtained by reacting a hydrocarbyl-substituted hydroxyaromatic compound, an aldehyde, and a polyamine having at least a primary amine and a terminal tertiary amine.

Representative hydrocarbyl-substituted hydroxyaromatic compounds suitable for forming the Mannich-based quaternary salt additives herein may include those of Formula II (Formula II)

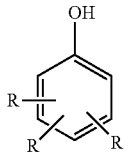

where each R is independently hydrogen, a C1-C4 alkyl group, or a hydrocarbyl substituent having a number average molecular weight (Mn) in the range of about 300 to about 5,000 (in other approaches, about 300 to about 2,000 and particularly about 500 to about 1,500) as determined gel permeation chromatography (GPC). In some approaches, at least one R is hydrogen and one R is a hydrocarbyl substituent as defined above.

In some approaches, suitable hydrocarbyl substituents may include polyolefin polymers or copolymers, such as polypropylene, polybutene, polyisobutylene, and ethylene alpha-olefin copolymers. Examples include polymers or copolymers of butylene and/or isobutylene and/or propylene, and one or more mono-olefinic co-monomers (e.g., ethylene, 1-pentene, 1-hexene, 1-octene, 1-decene, and the like) where the copolymer may include at least 50% by weight, of butylene and/or isobutylene and/or propylene units. The co-monomers polymerized with propylene or such butenes may be aliphatic and can also contain non-aliphatic groups, e.g., styrene, o-methylstyrene, p-methylstyrene, divinyl benzene and the like. Polyolefin polymer hydrocarbyl substituents can have at least 20%, in some cases at least 50%, and in other cases at least 70% of their olefin double bonds at a terminal position on the carbon chain as the highly reactive vinylidene isomer.

Polybutylene is one useful hydrocarbyl substituent for the hydroxyaromatic compound. Polybutylene substituents may include 1-butene or isobutene, as well as polymers made from mixtures of two or all three of 1-butene, 2-butene and isobutene. Polyisobutylene is another suitable hydrocarbyl substituent for the hydroxyaromatic compounds herein. High reactivity polyisobutenes having relatively high proportions of polymer molecules with a terminal vinylidene group, such as, at least 20% of the total terminal olefinic double bonds in the polyisobutene comprise an alkylvinylidene isomer, in some cases, at least 50% and, in other cases, at least 70%, formed by methods such as described, for example, in U.S. Pat. No. 4,152,499, are suitable polyalkenes for use in forming the hydrocarbyl substituted hydroxyaromatic reactant. Also suitable for use in forming the long chain substituted hydroxyaromatic reactants herein are ethylene alpha-olefin copolymers having a number average molecular weight of 500 to 3,000, wherein at least about 30% of the polymer's chains contain terminal ethylidene unsaturation.

In one embodiment, the hydrocarbyl-substituted hydroxyaromatic compound has one R that is H, one R that is a C1-C4 alkyl group (in some approaches, a methyl group), and one R is a hydrocarbyl substituent having an average molecular weight in the range of about 300 to about 2,000, such as a polyisobutylene substituent. In other embodiments, the hydrocarbyl-substituted hydroxyaromatic compound can be obtained by alkylating o-cresol with a high molecular weight hydrocarbyl polymer, such as a hydrocarbyl polymer having a number average molecular weight between about 300 to about 2,000, to provide an alkyl-substituted cresol. In some instances, o-cresol is alkylated with polyisobutylene having a number average molecular weight between about 300 to about 2,000 to provide a polyisobutylene-substituted cresol. In yet other instances, o-cresol is alkylated with polyisobutylene (PIB) having a number average molecular weight between about 500 to about 1,500 to provide a polyisobutylene-substituted cresol (PIB-cresol).

In yet other approaches, the hydrocarbyl-substituted hydroxyaromatic compound can be obtained by alkylating o-phenol with a high molecular weight hydrocarbyl polymer, such as a hydrocarbyl polymer group having a number average molecular weight between about 300 to about 2,000, to provide an alkyl-substituted phenol. In one embodiment, o-cresol is alkylated with polybutylene having a number average molecular weight between about 500 to about 1,500 to provide a polybutylene-substituted cresol.

Alkylation of the hydroxyaromatic compound may be performed in the presence of an alkylating catalyst, such as a Lewis acid catalyst (e.g., $BF_3$ or $AlCl_3$), at a temperature of about 30 to about 200° C. For a polyolefin used as the hydrocarbyl substituent, it may have a polydispersity (Mw/Mn) of about 1 to about 4, in other cases, from about 1 to about 2, as determined by GPC. Suitable methods of alkylating the hydroxyaromatic compounds are described in GB 1,159,368 or U.S. Pat. Nos. 4,238,628; 5,300,701 and 5,876,468, which are all incorporated herein by references in their entirety.

Representative aldehyde sources for use in the preparation of the Mannich base intermediate products herein include aliphatic aldehydes, aromatic aldehydes, and/or heterocyclic aldehydes. Suitable aliphatic aldehydes may include C1 to C6 aldehydes, such as formaldehyde, acetaldehyde, propionaldehyde, butyraldehyde, valeraldehyde, and hexanal aldehyde. Exemplary aromatic aldehydes may include benzaldehyde and salicylaldehyde, and exemplary heterocyclic aldehydes may include furfural and thiophene aldehyde. In some instances, formaldehyde-producing reagents such as paraformaldehyde, or aqueous formaldehyde solutions such as formalin may also be used in forming the Mannich-based tertiary amines herein. Most preferred is formaldehyde and/or formalin.

Suitable hydrocarbyl polyamines for the Mannich products herein include those with at least one primary amine and at least one terminal tertiary amine. In one approach, the hydrocarbyl polyamine has the structure $R_9R_{10}N—[CH_2]_a—X_b—[CH_2]_c—NR_9R_{10}$ wherein $R_9$ and $R_{10}$ are independently a hydrogen or a C1 to C6 alkyl group with one $R_9$ and $R_{10}$ pair forming a tertiary amine, X being an oxygen or a nitrogen, a is an integer from 1 to 10, b is an integer of 0 or 1, and c is an integer from 0 to 10. Suitable exemplary tertiary amine for forming the fuel additives herein may be selected from 3-(2-(dimethylamino)ethoxy)propylamine, N,N-dimethyl dipropylene triamine, dimethylamino propylamine, and/or mixtures thereof.

In one embodiment, the Mannich-based tertiary amines and fuel additives herein are obtained from a tertiary amine having the structure of Formula III (Formula III)

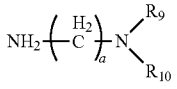

where $R_9$ and $R_{10}$ and integer a are as defined above. In other embodiments, the Mannich-based tertiary amines and fuel additives herein are obtained from a tertiary amine having the structure of Formula IV (Formula IV)

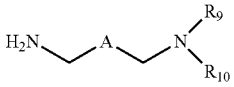

where A is a hydrocarbyl linker with 2 to 10 total carbon units and including one or more carbon units thereof independently replaced with a bivalent moiety selected from the group consisting of —O—, —N(R')—, —C(O)—, —C(O)O—, and —C(O)NR'. $R_9$ and $R_{10}$ are independently alkyl groups containing 1 to 8 carbon atoms, and R' is independently a hydrogen or a group selected from C1-6 aliphatic, phenyl, or alkylphenyl. In one approach, the select amines of Formula III or IV are at least diamines or triamines having a terminal primary amino group on one end for reaction with the hydrocarbyl substituted acylating agent and a terminal tertiary amine on the other end for reaction with the quaternizing agent. In other approaches, A includes 2 to 6 carbon units with one carbon unit thereof replaced with a —O— or a —NH— group. The hydrocarbyl linker A preferably has 1 to 4 carbon units replaced with the bivalent moiety described above, which is preferably a —O— or a —NH— group. In yet other approaches, 1 to 2 carbon units of the hydrocarbyl linker A and, in yet further approaches, 1 carbon unit of the hydrocarbyl linker A is replaced with the bivalent moiety described herein. As appreciated, the remainder of the hydrocarbyl linker A is preferably a carbon atom. The number of carbon atoms on either side of the replaced bivalent moiety need not be equal meaning the hydrocarbyl chain between the terminal primary amino group and the terminal tertiary amino group need not be symmetrical relative to the replaced bivalent moiety.

To prepare the Mannich-based tertiary amine reactants herein, a Mannich reaction of the selected polyamine, the hydrocarbyl-substituted hydroxyaromatic compound, and the aldehyde as described above may be conducted at a temperature about 30° C. to about 200° C. The reaction can be conducted in bulk (no diluent or solvent) or in a solvent or diluent. Water is evolved and can be removed by azeotropic distillation during the course of the reaction. For instance the temperature is typically increased, such as to about 150° C., when removing the water that is evolved in the reaction. Typical reaction times range from about 3 to about 4 hours, although longer or shorter times can be used as necessary or as desired.

An exemplary Mannich reaction can start with the addition of a hydrocarbyl-substituted hydroxyaromatic component to the reaction vessel together with a suitable solvent to obtain a blend. The blend is mixed under an inert atmosphere. Next, the polyamine is added when the blend is homogeneous and is at a moderate temperature, such as about 40 to about 45° C. Then, the selected aldehyde, such as formaldehyde, is added. The temperature rises, such as to about 45 to about 50° C., and the temperature may be further increased to less than 100° C., such as about 80° C., and maintained at such temperature for about 30 minutes to about 60 minutes. Distillation can then be conducted using a Dean Stark trap or equivalent apparatus and the temperature is set to about 130 to about 150° C., and it should be appreciated that distillation may start after a period of time to allow the reaction mixture to reach about 95 to 105° C. The temperature is maintained at the selected elevated temperature for sufficient time, which may be about an additional 2 hours to about 2.5 hours to produce the Mannich-based tertiary amine. Other suitable Mannich reaction schemes may be used as well to prepare the intermediate Mannich-based tertiary amine.

The so-formed Mannich-based tertiary amine is then alkylated or quaternized with a suitable alkylating or quaternizing agent. In one embodiment, a suitable alkylating or quaternizing agent is a hydrocarbyl carboxylate, such as an alkyl carboxylate. In such approaches, the quaternizing agent may be an alkyl carboxylate selected form alkyl oxalate, alkyl salicylate, and combinations thereof. In one aspect, the alkyl group of the alkyl carboxylate may include 1 to 6 carbon atoms, and is preferably methyl groups. A particularly useful alkyl carboxylate alkylation or quaternization may be dimethyl oxalate or methyl salicylate. The amount of alkyl carboxylate relative to the amount of tertiary amine reactant may range from a molar ratio of about 10:1 to about 1:10, e.g., about 3:1 to about 1:3.

For alkylation with alkyl carboxylates, it may be desirable that the corresponding acid of the carboxylate have a pKa of less than 4.2. For example, the corresponding acid of the carboxylate may have a pKa of less than 3.8, such as less than 3.5, with a pKa of less than 3.1 being particularly desirable. Examples of suitable carboxylates may include, but not limited to, maleate, citrate, fumarate, phthalate, 1,2,4-benzenetricarboxylate, 1,2,4,5-benzenetetra carboxylate, nitrobenzoate, nicotinate, oxalate, aminoacetate, and salicylate. As noted above, preferred carboxylates include oxalate, salicylate, and combinations thereof.

In another embodiment, a suitable alkylating or quaternizing agent may be a halogen substituted C2-C8 carboxylic acid, ester, amide, or salt thereof and may be selected from chloro-, bromo-, fluoro-, and iodo-C2-C8 carboxylic acids, esters, amides, and salts thereof. The salts may be alkali or alkaline earth metal salts selected from sodium, potassium, lithium calcium, and magnesium salts. A particularly useful halogen substituted compound for use in the reaction is the sodium or potassium salt of a chloroacetic acid. The amount of halogen substituted C2-C8 carboxylic acid, ester, amide, or salt thereof relative to the amount of tertiary amine reactant may range from a molar ratio of about 1:0.1 to about 0.1:1.0, e.g., about 1.0:0.5 to about 0.5:1.0.

When using such halogen-substituted quaternizing agents, the resultant Mannich-based quaternary ammonium salt may be a so-called internal salt that is substantially devoid of free anion species. As used herein the term "substantially devoid of free anion species" means that the anions, for the most part are covalently bound to the product such that the reaction product as made does not contain any substantial amounts of free anions or anions that are ionically bound to the product. In one embodiment, "substantially devoid" means from 0 to less than about 2 weight percent of free anion species.

The halogen substituted C2-C8 carboxylic acid, ester, amide, or salt thereof may be derived from a mono-, di-, or tri-chloro-bromo-, fluoro-, or iodo-carboxylic acid, ester, amide, or salt thereof selected from the group consisting of halogen-substituted acetic acid, propanoic acid, butanoic acid, isopropanoic acid, isobutanoic acid, tert-butanoic acid, pentanoic acid, heptanoic acid, octanoic acid, halo-methyl benzoic acid, and isomers, esters, amides, and salts thereof. The salts of the carboxylic acids may include the alkali or alkaline earth metal salts, or ammonium salts including, but not limited to the Na, Li, K, Ca, Mg, triethyl ammonium and triethanol ammonium salts of the halogen-substituted carboxylic acids. A particularly suitable halogen substituted carboxylic acid, or salt thereof may be selected from chloroacetic acid and sodium or potassium chloroacetate.

The Mannich-based quaternary ammonium salt of the present disclosure has the structure of Formula Is or Ib above and may be derived from the reaction of (i) the Mannich reaction product or derivative thereof having at least one tertiary amino group and prepared from a hydrocarbyl-substituted phenol, cresol, or derivative thereof, an aldehyde, and a hydrocarbyl polyamine providing the tertiary amino group and reacted with (ii) the quaternizing agent as discussed above and selected from the group consisting of a carboxylic or polycarboxylic acid, ester, amide, or salt thereof or halogen substituted derivative thereof.

In one embodiment or approach, the quaternary ammonium salt fuel additive has the structure of Formula Ia wherein $R_1$ is a hydrocarbyl radical derived from a 500 to 1,500 number average molecular weight polyisobutylene polymer or oligomer, $R_2$ is hydrogen or a methyl group, $R_3$ and $R_4$ are each hydrogen; a is an integer from 1 to 4, and b and c are each 0. In some approaches when the quaternizing agent is an alkyl carboxylate, such as dimethyl oxylate or methyl salicylate, $Y^{\ominus}$ of the Mannich quaternary ammonium salt is an anionic group having the structure $R_8C(O)O^{\ominus}$ with $R_8$ being the alkyl, the aryl, or the —C(O)O—$R_2$ group. An exemplary structures of this embodiment is shown below:

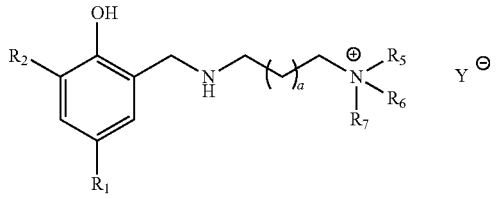

In yet other embodiments, quaternary ammonium salt fuel additive has the structure of Formula Ia wherein $R_1$ is a hydrocarbyl radical derived from a 500 to 1,500 number average molecular weight polyisobutylene polymer or oligomer; $R_2$ is hydrogen or a methyl group; $R_3$ together with $R_4$ is the —C(O)— group or the —$CH_2$— group forming a ring structure with the nitrogen atom closest to the aromatic ring; a is an integer from 1 to 4, b and c are each 0, In some approaches when the quaternizing agent is an alkyl carboxylate, such as dimethyl oxylate or methyl salicylate, $Y^{\ominus}$ of the Mannich quaternary ammonium salt is an anionic group having the structure $R_8C(O)O^{\ominus}$ with $R_8$ being the alkyl, the aryl, or the —C(O)O—$R_2$ group. Exemplary structures of this embodiment are shown below:

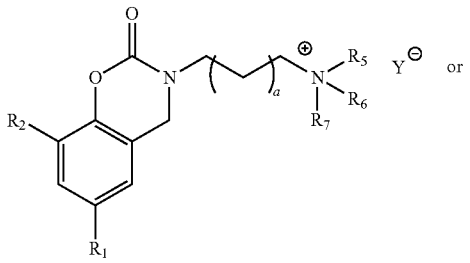

-continued

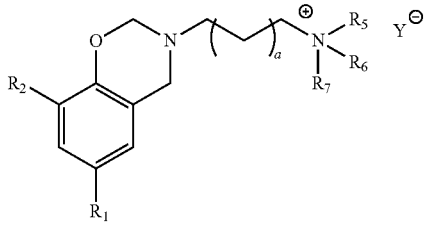

In further embodiments, the Mannich-based quaternary ammonium salt fuel additive has the structure of Formula Ia wherein $R_1$ is a hydrocarbyl radical derived from a 500 to 1500 number average molecular weight polyisobutylene polymer or oligomer, $R_2$ is hydrogen or a methyl group, $R_3$ is hydrogen, $R_4$ is hydrogen, the $C_1$-$C_6$ alkyl group, the —$(CH_2)_a$—$NR_5R_6$ group, or the —$(CH_2)_a$-Aryl$R_1R_2OR_3$ group, a is an integer from 1 to 4, b and c are each 0. In some approaches when the quaternizing agent is an alkyl carboxylate, such as dimethyl oxylate or methyl salicylate, $Y^{\ominus}$ of the Mannich quaternary ammonium salt is an anionic group having the structure $R_8C(O)O^{\ominus}$ with $R_8$ being the alkyl, the aryl, or the —C(O)O—$R_2$ group. Exemplary structures of this embodiment are shown below:

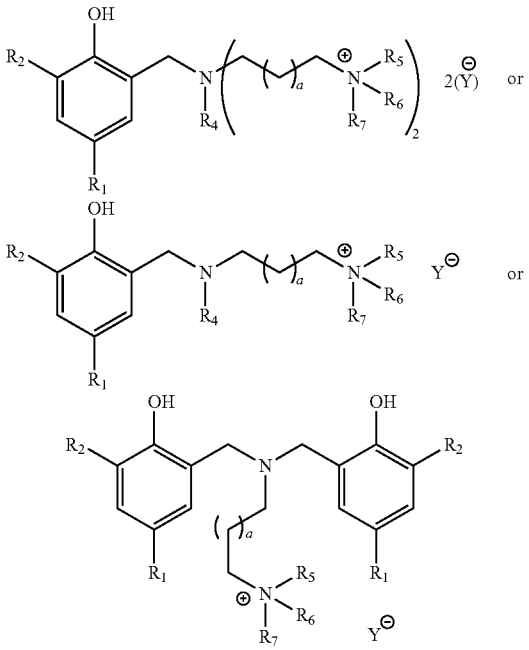

In other approaches, the Mannich-based quaternary ammonium salt fuel additive has the structure of Formula Ia wherein $R_1$ is a hydrocarbyl radical derived from a 500 to 1500 number average molecular weight polyisobutylene polymer or oligomer, $R_2$ is hydrogen or a methyl group, $R_3$ and $R_4$ are each hydrogen; a is an integer from 1 to 4, b is 1, c is an integer from 1 to 4, and X is nitrogen or oxygen. In some approaches when the quaternizing agent is an alkyl carboxylate, such as dimethyl oxylate or methyl salicylate, $Y^{\ominus}$ of the Mannich quaternary ammonium salt is an anionic group having the structure $R_8C(O)O^{\ominus}$ with $R_8$ being the alkyl, the aryl, or the —C(O)O—$R_2$ group. An exemplary structure of this embodiment is shown below:

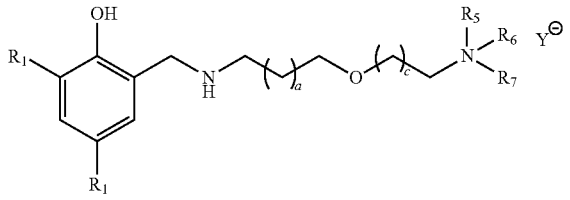

In other approaches, the Mannich-based quaternary ammonium salt fuel additive has the structure of Formula Ib wherein $R_1$ is a hydrocarbyl radical derived from a 500 to 1500 number average molecular weight polyisobutylene polymer or oligomer, $R_2$ is hydrogen or a methyl group, and R' is a methylene group. In some approaches when the quaternizing agent is an alkyl carboxylate, such as dimethyl oxylate or methyl salicylate, $Y^{\ominus}$ of the Mannich quaternary ammonium salt is an anionic group having the structure $R_8C(O)O^{\ominus}$ with $R_8$ being the alkyl, the aryl, or the —C(O)O—$R_2$ group. An exemplary structure of this embodiment is shown below:

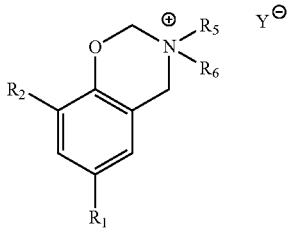

When formulating fuel compositions of this application, the above described additives (reaction products and/or resultant additives as described above) may be employed in amounts sufficient to reduce or inhibit deposit formation in a fuel system, a combustion chamber of an engine and/or crankcase, and/or within fuel injectors. In some aspects, the fuels may contain minor amounts of the above described reaction product or resulting salt thereof that controls or reduces the formation of engine deposits, for example injector deposits in engines. For example, the fuels of this disclosure may contain, on an active ingredient basis, an amount of the Mannich-based quaternary ammonium salt (or reaction product as described herein) in the range of about 1 ppm to about 500 ppm, in other approaches, about 5 ppm to about 300 ppm, in yet further approaches about 20 ppm to about 100 ppm of the quaternary ammonium salt. In diesel, the fuels may contain about 10 to about 500 ppm, in other approaches, about 20 to about 300 ppm, and in yet other approaches, about 30 to about 100 ppm. In gasoline, the fuels, may preferably contain about 1 to about 50 ppm, in other approaches, about 2 to about 30 ppm, and in yet other approaches, about 5 to about 20 ppm. It will also be appreciated that any endpoint between the above described ranges are also suitable range amounts as needed for a particular application. The active ingredient basis excludes the weight of (i) unreacted components associated with and remaining in the product as produced and used, and (ii) solvent(s), if any, used in the manufacture of the product either during or after its formation.

Other Additives

One or more optional compounds may be present in the fuel compositions of the disclosed embodiments. For example, the fuels may contain conventional quantities of cetane improvers, octane improvers, corrosion inhibitors, cold flow improvers (CFPP additive), pour point depressants, solvents, demulsifiers, lubricity additives, friction modifiers, amine stabilizers, combustion improvers, detergents, dispersants, antioxidants, heat stabilizers, conductivity improvers, metal deactivators, marker dyes, organic nitrate ignition accelerators, cyclomatic manganese tricarbonyl compounds, carrier fluids, and the like. In some aspects, the compositions described herein may contain about 10 weight percent or less, or in other aspects, about 5 weight percent or less, based on the total weight of the additive concentrate, of one or more of the above additives. Similarly, the fuels may contain suitable amounts of conventional fuel blending components such as methanol, ethanol, dialkyl ethers, 2-ethylhexanol, and the like.

In some aspects of the disclosed embodiments, organic nitrate ignition accelerators that include aliphatic or cycloaliphatic nitrates in which the aliphatic or cycloaliphatic group is saturated, and that contain up to about 12 carbons may be used. Examples of organic nitrate ignition accelerators that may be used are methyl nitrate, ethyl nitrate, propyl nitrate, isopropyl nitrate, allyl nitrate, butyl nitrate, isobutyl nitrate, sec-butyl nitrate, tert-butyl nitrate, amyl nitrate, isoamyl nitrate, 2-amyl nitrate, 3-amyl nitrate, hexyl nitrate, heptyl nitrate, 2-heptyl nitrate, octyl nitrate, isooctyl nitrate, 2-ethylhexyl nitrate, nonyl nitrate, decyl nitrate, undecyl nitrate, dodecyl nitrate, cyclopentyl nitrate, cyclohexyl nitrate, methylcyclohexyl nitrate, cyclododecyl nitrate, 2-ethoxyethyl nitrate, 2-(2-ethoxyethoxy)ethyl nitrate, tetrahydrofuranyl nitrate, and the like. Mixtures of such materials may also be used.

Examples of suitable optional metal deactivators useful in the compositions of the present application are disclosed in U.S. Pat. No. 4,482,357, the disclosure of which is herein incorporated by reference in its entirety. Such metal deactivators include, for example, salicylidene-o-aminophenol, disalicylidene ethylenediamine, disalicylidene propylenediamine, and N,N'-disalicylidene-1,2-diaminopropane.

Suitable optional cyclomatic manganese tricarbonyl compounds which may be employed in the compositions of the present application include, for example, cyclopentadienyl manganese tricarbonyl, methylcyclopentadienyl manganese tricarbonyl, indenyl manganese tricarbonyl, and ethylcyclopentadienyl manganese tricarbonyl. Yet other examples of suitable cyclomatic manganese tricarbonyl compounds are disclosed in U.S. Pat. Nos. 5,575,823 and 3,015,668 both of which disclosures are herein incorporated by reference in their entirety.

Other commercially available detergents may be used in combination with the reaction products described herein. Such detergents include but are not limited to succinimides, Mannich base detergents, quaternary ammonium detergents, bis-aminotriazole detergents as generally described in U.S. patent application Ser. No. 13/450,638, and a reaction product of a hydrocarbyl substituted dicarboxylic acid, or anhydride and an aminoguanidine, wherein the reaction product has less than one equivalent of amino triazole group per molecule as generally described in U.S. patent application Ser. Nos. 13/240,233 and 13/454,697.

The additives of the present application, including the Mannich-based quaternary ammonium salts described above, and optional additives used in formulating the fuels of this invention may be blended into the base fuel individually or in various sub-combinations. In some embodiments, the additive components of the present application may be blended into the fuel concurrently using an additive concentrate, as this takes advantage of the mutual compatibility and convenience afforded by the combination of ingredients when in the form of an additive concentrate. Also, use of a concentrate may reduce blending time and lessen the possibility of blending errors.

Fuels

The fuels of the present application may be applicable to the operation of diesel, jet, or gasoline engines. In one approach, the quaternary ammonium salts herein are well suited for diesel or gasoline as shown in the Examples. The engines may include both stationary engines (e.g., engines used in electrical power generation installations, in pumping stations, etc.) and ambulatory engines (e.g., engines used as prime movers in automobiles, trucks, road-grading equipment, military vehicles, etc.). For example, the fuels may include any and all middle distillate fuels, diesel fuels, biorenewable fuels, biodiesel fuel, fatty acid alkyl ester, gas-to-liquid (GTL) fuels, gasoline, jet fuel, alcohols, ethers, kerosene, low sulfur fuels, synthetic fuels, such as Fischer-Tropsch fuels, liquid petroleum gas, bunker oils, coal to liquid (CTL) fuels, biomass to liquid (BTL) fuels, high asphaltene fuels, fuels derived from coal (natural, cleaned, and petcoke), genetically engineered biofuels and crops and extracts therefrom, and natural gas. "Biorenewable fuels" as used herein is understood to mean any fuel which is derived from resources other than petroleum. Such resources include, but are not limited to, corn, maize, soybeans and other crops; grasses, such as switchgrass, miscanthus, and hybrid grasses; algae, seaweed, vegetable oils; natural fats; and mixtures thereof. In an aspect, the biorenewable fuel can comprise monohydroxy alcohols, such as those comprising from 1 to about 5 carbon atoms. Non-limiting examples of suitable monohydroxy alcohols include methanol, ethanol, propanol, n-butanol, isobutanol, t-butyl alcohol, amyl alcohol, and isoamyl alcohol. Preferred fuels include diesel fuels.

Accordingly, aspects of the present application are directed to methods of or the use of the quaternary ammonium compounds herein for reducing injector deposits in an internal combustion engine or fuel system for an internal combustion engine, cleaning-up fouled injectors, or unsticking injectors. In another aspect, the quaternary ammonium compounds described herein or fuel containing the quaternary ammonium compounds herein may be combined with one or more of polyhydrocarbyl-succinimides, -acids, -amides, -esters, -amide/acids and -acid/esters, reaction products of polyhydrocarbyl succinic anhydride and aminoguanidine and its salts, Mannich compounds, and mixtures thereof. In other aspects, the methods or use include injecting a hydrocarbon-based fuel comprising a quaternary ammonium compounds of the present disclosure through the injectors of the engine into the combustion chamber, and igniting the fuel to prevent or remove deposits on fuel injectors, to clean-up fouled injectors, and/or to unstick injectors. In some aspects, the method may also comprise mixing into the fuel at least one of the optional additional ingredients described above.

EXAMPLES

The following examples are illustrative of exemplary embodiments of the disclosure. In these examples as well as elsewhere in this application, all ratios, parts, and percentages are by weight unless otherwise indicated. It is intended that these examples are being presented for the purpose of illustration only and are not intended to limit the scope of the invention disclosed herein.

Example 1

A sample of an alkylated cresol (2736.2 g, 2.52 mol) made with polyisobutylene (1000 MW) and cresol was measured into a sealable reaction vessel. The predominant structure for this sample was believed to be compound 1:

(Compound 1)

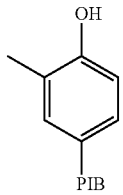

To this was added 3,3',3"-(1,3,5-triazinane-1,3,5-triyl)tris (N,N-dimethylpropan-1-amine) (296.75 g, 866.25 mmol). This was heated slowly to 130° C. with occasional shaking over 4.5 hours. The reaction mixture was held at 130° C. for 16.5 hours followed by heating to 140° C. for another 2.5 hours. According to the $^{13}$C NMR, the major product was believed to be the following Mannich reaction product of compound 2:

(Compound 2)

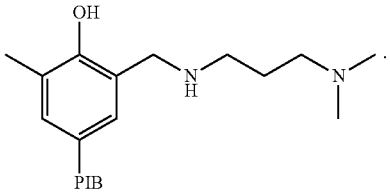

Example 2

A 250 mL flask was charged with the DMAPA substituted Mannich product of Example 1 (19.55 g, 16.24 mmol) dissolved in toluene (500 g) and cooled in an ice bath. Potassium carbonate (8.975 g, 64.94 mmol) was added with stirring. A solution of 20% phosgene in toluene (10.9 g, 24.35 mmol) was added dropwise over 10 minutes. The reaction was allowed to warm to room temperature and stir overnight. Product was purified by basic work up and filtration. According to the $^{13}$C NMR, the major product was believed to be the following Mannich reaction product of compound 3:

(Compound 3)

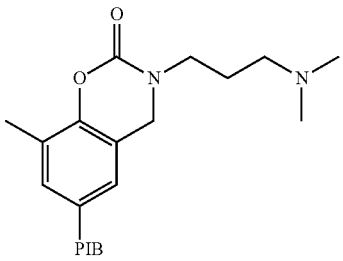

Example 3

A 2 L flask was charged with the previously described 3-(Dimethylamino)-1-propylamine (DMAPA) substituted Mannich product of Example 1 (612.21 g, 510.18 mmol), a 37% aqueous formaldehyde solution (42.21 g, 522.93 mmol) and toluene (160 g). Reaction was heated slowly to about 140° C. for over about 1.5 hours while removing water by Dean-Stark trap. Solvent was then removed under reduced pressure to yield the product as a neat oil. According to the $^{13}$C NMR, the major product was believed to be the following cyclic reaction product of compound 4:

(Compound 4)

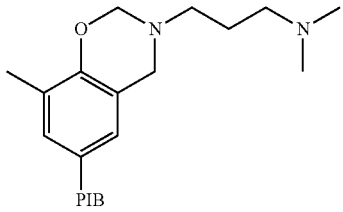

Example 4

A 2 L flask was charged with the previously described alkylated cresol compound 1 of Example 1 (538.9 g, 508.4 mmol), 3,3'-iminobis(N,N-dimethylpropylamine) (97.62 g, 521.11 mmol) and Toluene (170 g). The reaction mixture was heated to 50° C. and a 37% aqueous formaldehyde solution (42.76 g, 521.11 mmol) was added over about 8 minutes. Reaction was slowly heated to about 140° C. for over about 4 hours while removing water by DS trap. Solvent was then removed under reduced pressure. According to the $^{13}$C NMR, the major product was believed to be the following reaction product of compound 5:

(Compound 5)

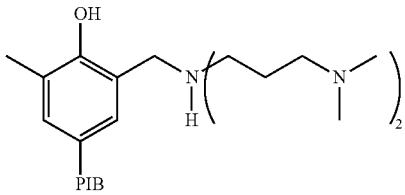

Example 5

A 2 L flask was charged with the previously described alkylated cresol compound 1 of Example 1 (851.1 g, 784.42 mmol), $N^1$-isopropyl-$N^3$,$N^3$-dimethylpropane-1,3-diamine (119.05 g, 825.21 mmol) and Toluene (206.6 g). The reaction mixture was heated to 50° C. and a 37% aqueous formaldehyde solution (68.09 g, 784.42 mmol) was added over about 5 minutes. The reaction was slowly heated to about 145° C. for over about 5 hours while removing water by DS trap. Solvent was then removed under reduced pressure. According to the $^{13}$C NMR, the major product was believed to be the following reaction product of compound 6:

(Compound 6)

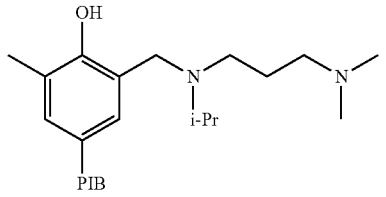

Example 6

A 1 L flask was charged with the previously described alkylated cresol compound 1 of Example 1 (440 g, 401.8 mmol), (2-Dimethylaminoethoxy)-3-propanylamine (59.93 g, 409.9 mmol) and Toluene (167 g). The reaction mixture was heated to 35° C. and a 37% aqueous formaldehyde solution (33.3 g, 409.9 mmol) was added over about 10 minutes. The reaction was slowly heated to about 100° C. for about 1.5 hours, and then heated to about 155° C. for over about 2.5 hours while removing water by DS trap. Solvent was then removed under reduced pressure. According to the $^{13}$C NMR, the major product was believed to be the following reaction product of compound 7:

(Compound 7)

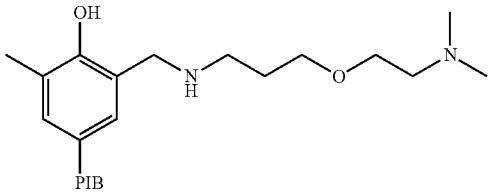

Example 7

A 1 L flask was charged with the previously described alkylated cresol compound 1 of Example 1 (459.7 g, 433.68 mmol), a 40% aqueous solution of methyl amine (38.06 g, 477.91 mmol), a 37% aqueous formaldehyde solution (75.12 g, 915.50 mmol) and toluene (100.5 g). Reaction was heated very slowly to about 140° C. for over about 12 hours while removing water by DS trap. Solvent was then removed under reduced pressure. According to the $^{13}$C NMR, the major product was believed to be the following cyclic reaction product of compound 8:

(Compound 8)

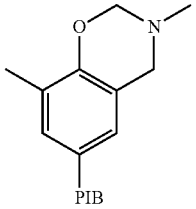

Example 8

A 2 L flask was charged with the previously described alkylated cresol compound 1 of Example 1 (832.4 g, 743.0 mmol), 3-(Dimethylamino)-1-propylamine (DMAPA) (40 g, 391.47 mmol) and Toluene (203 g). The reaction mixture was heated to 35° C. and a 37% aqueous formaldehyde solution (62.48 g, 761.5 mmol) was added over about 10 minutes. The reaction was slowly heated to about 140° C. for over three hours, and held for one hour while removing water by DS trap. Solvent was then removed under reduced pressure. According to the $^{13}$C NMR, the major product was believed to be the following reaction product of compound 9:

(Compound 9)

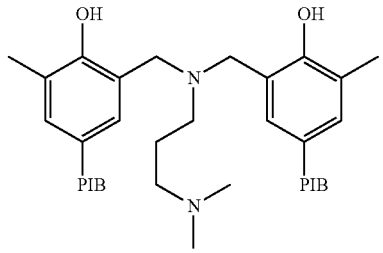

Example 10

One procedure for forming an internal salt or a Mannich based betaine fuel additive of any of the compounds of Example 1 to 9 includes the following: a 500 mL round bottom flask was charged with the selected Mannich based tertiary amine (64.47 mmol) and 2-Ethylhexanol (23 g). Solution was heated to 55° C. Ethyl Chloroacetate (7.37 g, 60.14 mmol) was added dropwise. Reaction was then heated to 75° C. for 12 hours. Reaction was cooled to 55° C. and a 45% aqueous potassium hydroxide solution (7.124 g, 57.13 mmol) was added dropwise followed by a 10% aqueous solution of potassium carbonate (4.16 g, 3.01 mmol) and reaction was heated to 70° C. for 3 hours. Water was then removed under reduced pressure and solution was then diluted with 2-ethylhexanol (134.34 g). Solution was allowed to cool and solids were removed by filtration to yield desired Mannich based Betaine as solution in 2-EH. According to the $^{13}$C NMR, the major product was believed to be the following reaction product where R' and R would be dependent on the structure of the selected Mannich based tertiary amine as described herein:

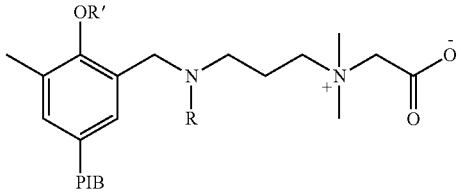

Example 11

One procedure for Quaternization of a Mannich based tertiary amine by dimethyl oxalate includes the following: A 250 mL round bottom flask was charged with Mannich based tertiary amine (87.8 mmol), dimethyl oxalate (11.41 g, 96.6 mmol) and A150 (13.49 g). Reaction was then heated to 120° C. for 6 hours before being cooled to room temperature.

Example 12

Another procedure for quaternizing by dimethyl oxalate includes the following: A 250 mL round bottom flask was charged with a Mannich-based tertiary amine (67.14 mmol) and dimethyl oxalate (23.79 g, 201.42 mmol). Reaction was then heated to 120° C. for 6 hours. A second addition of dimethyl oxalate (15.85 g, 134.28 mmol) was added and reaction continued for another 12 hours. Reaction was allowed to cool to room temperature. Hexanes (75 g) was added and reaction was warmed until fully dissolved and then cooled until residual dimethyl oxalate had crystalized out. Solids were removed by filtration and solvent removed under reduced pressure to yield desired product. According to the $^{13}C$ NMR, the major product was believed to be the following reaction product where R' and R would be dependent on the structure of the selected Mannich based tertiary amine as described herein

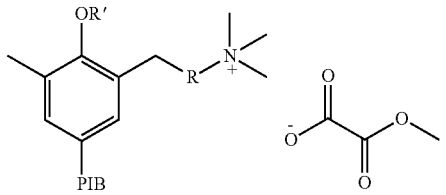

Example 13

An 80 weight % solution (in Aromatic 100 solvent) of a commercial sample of a Mannich fuel detergent made with polyisobutylene (1000 MW) cresol, DMAPA and formaldehyde (166.18 g, 150 mmol) was measured into a 500 ml round bottom reaction flask equipped with a nitrogen port and a condenser. The predominant structure for this detergent was believed to be as shown below as compound 10.

(Compound 10)

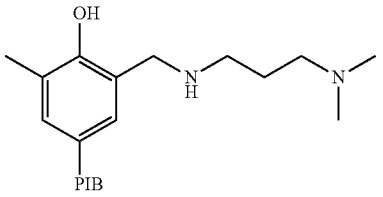

To this solution was added dimethyl oxalate (18.39 g, 156 mmol). This mixture was heated to 125° C. for 3 hours. During the heating period, the mixture was stirred under a nitrogen atmosphere. At the end of the heating period, Aromatic 150 (80 g) was added to bring the total solvent concentration to 40 weight %. A $^{13}C$ NMR spectrum of the product surprisingly indicated that the quaternization of the tertiary amine had gone to completion.

Example 14

An 80 weight % solution of a commercial sample of a Mannich fuel detergent made with polyisobutylene (1000 MW) phenol, DMAPA and formaldehyde (176.06 g, 159 mmol) was measured into a 500 ml round bottom reaction flask equipped with a nitrogen port and a condenser. The predominant structure for this detergent was believed to be as shown below as compound 11.

(Compound 11)

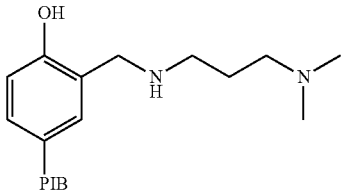

To this solution was added dimethyl oxalate (19.35 g, 164 mmol). This mixture was heated to 125° C. for 3.5 hours. During the heating period, the mixture was stirred under a nitrogen atmosphere. At the end of the heating period, Aromatic 150 (86.3 g) was added to bring the total solvent concentration to 41 weight %. A $^{13}C$ NMR spectrum of the product surprisingly indicated that the quaternization of the tertiary amine had gone to completion.

Example 15

A DW-10 test was performed to determine the inventive additives ability to clean up fouled injectors in a diesel engine using a test outlined in CEC F-98-08. Using the test cycle and dopant (1 ppm Zn as zinc neodecanoate) used in CEC F-98-08, inventive additives were evaluated for their ability in diesel fuel to remove (clean up) deposits. To perform this evaluation, the engine was first run with zinc dopant in the fuel, resulting in a power loss due to fouling of the injector holes. Then, the engine was run on fuel containing both the zinc dopant and detergent additive(s). A more detailed description of this protocol can be found in U.S. Pat. No. 8,894,726 B2 (Column 9) or U.S. Pat. No. 9,464,252 B2 (columns 10 and 11), which are incorporated herein by reference and further discussed below. The results are shown below in Tables 2-4.

Diesel Engine Test Protocol: The DW-10 test was developed by Coordinating European Council (CEC) to demonstrate the propensity of fuels to provoke fuel injector fouling and can also be used to demonstrate the ability of certain fuel additives to prevent or control these deposits. Additive evaluations used the protocol of CEC F-98-08 for direct injection, common rail diesel engine nozzle coking tests. An engine dynamometer test stand was used for the installation of the Peugeot DW10 diesel engine for running the injector coking tests. The engine was a 2.0 liter engine having four cylinders. Each combustion chamber had four valves and the fuel injectors were DI piezo injectors have a Euro V classification.

The core protocol procedure consisted of running the engine through a cycle for 8-hours and allowing the engine to soak (engine off) for a prescribed amount of time. The foregoing sequence was repeated four times. At the end of each hour, a power measurement was taken of the engine while the engine was operating at rated conditions. The injector fouling propensity of the fuel was characterized by a difference in observed rated power between the beginning and the end of the test cycle.

Test preparation involved flushing the previous test's fuel from the engine prior to removing the injectors. The test injectors were inspected, cleaned, and reinstalled in the engine. If new injectors were selected, the new injectors were put through a 16-hour break-in cycle. Next, the engine was started using the desired test cycle program. Once the engine was warmed up, power was measured at 4,000 RPM and full load to check for full power restoration after cleaning the injectors. If the power measurements were within specification, the test cycle was initiated. Table 2 below provides a representation of the DW-10 coking cycle that was used to evaluate the fuel additives according to the disclosure.

TABLE 2

One hour representation of DW-10 coking cycle

| Step | Duration (minutes) | Engine speed (rpm) | Load (%) | Torque (Nm) | Boost air after Intercooler (° C.) |
|---|---|---|---|---|---|
| 1 | 2 | 1750 | 20 | 62 | 45 |
| 2 | 7 | 3000 | 60 | 173 | 50 |
| 3 | 2 | 1750 | 20 | 62 | 45 |
| 4 | 7 | 3500 | 80 | 212 | 50 |
| 5 | 2 | 1750 | 20 | 62 | 45 |
| 6 | 10 | 4000 | 100 | * | 50 |
| 7 | 2 | 1250 | 10 | 25 | 43 |
| 8 | 7 | 3000 | 100 | * | 50 |
| 9 | 2 | 1250 | 10 | 25 | 43 |
| 10 | 10 | 2000 | 100 | * | 50 |
| 11 | 2 | 1250 | 10 | 25 | 43 |
| 12 | 7 | 4000 | 100 | * | 50 |

Fuel additives A to P of Table 3 were quaternized using either dimethyl oxylate (DMO) or ethyl chloroacetate (ECA) as set forth in the Table using the procedures of the Examples above and were tested using the foregoing engine test procedure in an ultra-low sulfur diesel fuel containing zinc neodecanoate, 2-ethylhexyl nitrate, and a fatty acid ester friction modifier (base fuel). A "dirty-up" phase consisting of base fuel only with no additive was initiated, followed by a "clean-up" phase consisting of base fuel plus additive as noted in Table 3 below. All runs were made with 8 hour dirty-up and 8 hour clean-up unless indicated otherwise. The percent power recovery was calculated using the power measurement at end of the "dirty-up" phase and the power measurement at end of the "clean-up" phase. The percent power recovery was determined by the following formula: Percent Power recovery=(DU−CU)/DU×100, wherein DU is a percent power loss at the end of a dirty-up phase without the additive, CU is the percent power at the end of a clean-up phase with the fuel additive, and power is measured according to CEC F98-08 DW10 test. Fuel samples 1 to 16 included mannich-based quaternary salt additives A through P of Table 3 and Fuel sample 17 is a control with no Mannich-based quaternary salt additive.

TABLE 3

Mannich-Based Quaternary Ammonium Salt Fuel Additives

| Fuel Additive | Mannich-based Tertiary Amine | Quat Agent | Mol Ratio of Amine to Quat Agent |
|---|---|---|---|
| A | Compound 3 | DMO | 1:1.5 |
| B | Compound 4 | DMO | 1:1.5 |
| C | Compound 6 | DMO | 1:1.5 |
| D | Compound 10 | DMO | 1:2 |
| E | Compound 5 | DMO | 1:3 |
| F | Compound 10 | DMO | 1:1 |
| G | Compound 8 | DMO | 1:5 |
| H | Compound 11 | DMO | 1:1 |
| I | Compound 5 | DMO | 1:2.2 |
| J | Compound 7 | DMO | 1:1.1 |
| K | Compound 9 | DMO | 1:1 |
| L | Compound 11 | DMO | 1:1 |
| M | Compound 4 | ECA | 1:0.95 |
| N | Compound 4 | ECA | 1:0.95 |
| O | Compound 10 | DMO | 1:2 |
| P | Compound 6 | ECA | 1:0.95 |

TABLE 4

DW-10B Test Results - Clean Up

| Fuel | Additive | Active Treat Rate(s) (ppmw) | Power Loss after Dirty Up (%) | Power Loss after 8 hours of Clean Up (%) | Cleanup or Power Recovery (DU-CU)/DUX100 (%) |
|---|---|---|---|---|---|
| F1 | A | 100 | 5.23 | 0.25 | 92.5 |
| F2 | B | 100 | 5.7 | 2.29 | 59.8 |
| F3 | C | 100 | 4.48 | 5.36 | −19.6 |
| F4 | D | 100 | 5.36 | 2.82 | 47.4 |
| F5 | E | 100 | 4.6 | 4.17 | 9.3 |
| F6 | F | 100 | 4.13 | 0.67 | 83.8 |
| F7 | G | 100 | 5.9 | 0.82 | 86.1 |
| F8 | H | 100 | 10.31 | 4.93 | 52.2 |
| F9 | I | 100 | 5.37 | 4.26 | 20.7 |
| F10 | J | 100 | 7.04 | 3.31 | 53.0 |
| F11 | K | 100 | 5.74 | 4.58 | 20.2 |
| F12* | L | 100 | 6.25 | 1.91 | 69.4 |
| F13 | M | 100 | 4.51 | 3.67 | 18.6 |
| F14** | N | 100 | 3.67 | 2.23 | 39.2 |
| F15 | O | 100 | 5.1 | 2.56 | 49.8 |
| F16 | P | 100 | 5 | 6.23 | −24.6 |
| F17 | None | None | 5.0 | 7.8 | −56.0 |

*Fuel F12 included 50 ppm of a C16C18 polyol, which is a commercially available polypropylene glycol in which one end is capped with C16-C18 alkyl alcohol.
*Fluid F14 included 100 ppm of PIBSI, which is a 1000 Mn polyisobytylene succinimide.

Example 16

Fuel additives A, B, F, and H of Example 15 above were further tested for ability to clean-up fouled injectors in a gasoline direct injection (GDI) engine using the procedure set forth in U.S. Pat. No. 10,308,888 B1 and Shanahan, C., Smith, S., and Sears, B., "A General Method for Fouling Injectors in Gasoline Direct Injection Vehicles and the Effects of Deposits on Vehicle Performance," SAE Int. J. Fuels Lubr. 10(3):2017, doi:10.4271/2017-01-2298, which are both incorporated herein by reference and discussed further below.

The GDI testing involved the use of a fuel blend to accelerate the dirty-up phase or injector fouling of the GDI engine. The accelerated fuel blend included 409 ppmw of di-tert-butyl disulfide (DTBDS, contributing about 147 ppmw active sulfur to the fuel) and 286 ppmw of tert-butyl hydrogen peroxide (TBNP). The test involved running a 2013 or 2014 Kia Optima or equivalent having a 2.4 L, 16 valve, inline 4 gasoline direct injection engine on a mileage accumulation dynamometer. The engine was run using the Quad 4 drive cycle as set forth in the above noted SAE paper (SAE 2017-01-2298). The tested fuel contained, in addition to the above-described fuel additive, a commercial GPA package HiTEC® 6590 at a treat rate of 243.7 ppmw. Injector cleanliness was measured using Long Term Fuel Trim (LTFT) as reported by the vehicle engine control unit (ECU) and was measured relative to the accumulated mileage. Results of the GDI testing are shown below in Table 5.

TABLE 5

Gasoline engine clean-up test results

| Additive | Active Treat Rate(s) PTB | Active Treat Rate(s) ppmw | Change in LTFT from SOT after Dirty Up, % (%) | Change in LTFT from SOT after Clean Up, % (%) | % Cleanup or power recovery (DU-CU)/DUX100 (%) |
|---|---|---|---|---|---|
| A | 5 | 19.1 | −5.83 | 0.48 | 108.2% |
| B | 5 | 19.1 | −5.49 | −0.55 | 90.0% |
| F | 5 | 19.1 | −9.27 | −0.86 | 90.7% |
| H | 5 | 19.1 | −5.78 | 0.27 | 104.7% |
| None | None | None | −6.57 | −7.20 | −9.6% |

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

The following describes additional embodiments of the present disclosure:

1. A quaternary ammonium salt fuel additive comprising the structure of Formula I (Formula I)

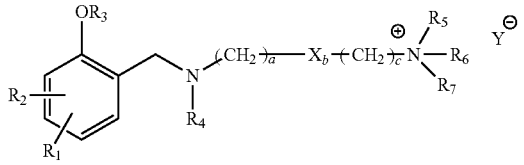

wherein $R_1$ is a hydrocarbyl radical, wherein the number average molecular weight of the hydrocarbyl is about 200 to about 5,000; $R_2$ is hydrogen or a $C_1$-$C_6$ alkyl group; $R_3$ is hydrogen or, together with $R_4$, a —C(O)— group or a —$CH_2$— group forming a ring structure with the nitrogen atom closest to the aromatic ring; $R_4$ is one of hydrogen, $C_1$-$C_6$ alkyl, —$(CH_2)_a$—$NR_5R_6$, —$(CH_2)_a$-Aryl($R_1$)($R_2$)($OR_3$), or together with $R_3$, a —C(O)— group or a —$CH_2$— group forming a ring structure with the nitrogen atom closest to the aromatic ring; $R_5$ is $C_1$-$C_6$ alkyl or, together with $Y^{\ominus}$, forms a $C_1$-$C_6$ alkyl substituted —C(O)$O^{\ominus}$; $R_6$ and $R_7$, independently, are $C_1$-$C_6$ alkyl; a is an integer from 1 to 10, b is an integer selected from either 0 or 1, and c is an integer from 0 to 10; X is oxygen or nitrogen; and $Y^{\ominus}$ is an anionic group having a structure $R_8C(O)O^{\ominus}$ wherein $R_8$ is one of (i) together with $R_5$ a C1-C6 alkyl group or (ii) a $C_1$-$C_6$ alkyl, an aryl, a $C_1$-$C_4$ alklylene-C(O)O—$R_2$ or a —C(O)O—$R_2$ group.

2. The quaternary ammonium salt fuel additive of embodiment 1, wherein $R_1$ is a hydrocarbyl radical derived from a polyisobutylene polymer or oligomer, the number average molecular weight being about 500 to about 1,500, $R_2$ is hydrogen or a methyl group, $R_3$ and $R_4$ are each hydrogen; a is an integer from 1 to 4, and b and c are each 0.

3. The quaternary ammonium salt fuel additive of embodiment 2, wherein $R_5$, $R_6$, and $R_7$ are each $C_1$-$C_6$ alkyl and wherein $Y^{\ominus}$ is the anionic group having the structure $R_8C(O)O^{\ominus}$ with $R_8$ being the $C_1$-$C_6$ alkyl, an aryl, a $C_1$-$C_4$ alklylene-C(O)O—$R_2$ or a —C(O)O—$R_2$ group.

4. The quaternary ammonium salt fuel additive of embodiment 1, wherein $R_1$ is a hydrocarbyl radical derived from a polyisobutylene polymer or oligomer; $R_2$ is hydrogen or a methyl group, the number average molecular weight being about 500 to about 1,500, $R_3$ together with $R_4$ is the —C(O)— group or the —$CH_2$— group forming a ring structure with the nitrogen atom closest to the aromatic ring; a is an integer from 1 to 4, b and c are each 0.

5. The quaternary ammonium salt fuel additive of embodiment 4, wherein and $R_5$, $R_6$, and $R_7$ are each $C_1$-$C_6$ alkyl and wherein $Y^{\ominus}$ is the anionic group having the structure $R_8C(O)O^{\ominus}$ with $R_8$ being the $C_1$-$C_6$ alkyl, an aryl, a $C_1$-$C_4$ alklylene-C(O)O—$R_2$ or a —C(O)O—$R_2$ group.

6. The quaternary ammonium salt fuel additive of embodiment 1, wherein $R_1$ is a hydrocarbyl radical derived from a polyisobutylene polymer or oligomer, the number average molecular weight being about 500 to about 1,500, $R_2$ is hydrogen or a methyl group, $R_3$ is hydrogen, $R_4$ is the $C_1$-$C_6$ alkyl group, the —$(CH_2)_a$—$NR_5R_6$ group, or the —$(CH_2)_a$-Aryl$R_1R_2OR_3$ group, a is an integer from 1 to 4, b and c are each 0

7. The quaternary ammonium salt fuel additive of embodiment 6, wherein and $R_5$, $R_6$, and $R_7$ are each $C_1$-$C_6$ alkyl and wherein $Y^{\ominus}$ is the anionic group having the structure $R_8C(O)O^{\ominus}$ with $R_8$ being the $C_1$-$C_6$ alkyl, an aryl, a $C_1$-$C_4$ alklylene-C(O)O—$R_2$ or a —C(O)O—$R_2$ group.

8. The quaternary ammonium salt fuel additive of embodiment 1, wherein $R_1$ is a hydrocarbyl radical derived from a polyisobutylene polymer or oligomer, the number average molecular weight being about 500 to about 1,500, $R_2$ is hydrogen or a methyl group, $R_3$ and $R_4$ are each hydrogen; a is an integer from 1 to 4, b is 1, c is an integer from 1 to 4, and X is nitrogen or oxygen.

9. The quaternary ammonium salt fuel additive of embodiment 8, wherein and $R_5$, $R_6$, and $R_7$ are each $C_1$-$C_6$ alkyl and wherein $Y^{\ominus}$ is the anionic group having the structure $R_8C(O)O^{\ominus}$ with $R_8$ being the $C_1$-$C_6$ alkyl, an aryl, a $C_1$-$C_4$ alklylene-C(O)O—$R_2$ or a —C(O)O—$R_2$ group.

10. The quaternary ammonium salt fuel additive of embodiment 1, wherein the quaternary ammonium salt fuel additive is derived from (i) a Mannich reaction product or derivative thereof having at least one tertiary amino group and prepared from a hydrocarbyl-substituted phenol, cresol, or derivative thereof, an aldehyde, and a hydrocarbyl polyamine providing the tertiary amino group and reacted with (ii) a quaternizing agent selected from the group consisting of a carboxylic or polycarboxylic acid, ester, amide, or salt thereof or halogen substituted derivative thereof.

11. The quaternary ammonium salt fuel additive of embodiment 10, wherein the hydrocarbyl polyamine has the structure $R_9R_{10}N$—$[CH_2]_a$—$X_b$—$[CH_2]_c$—$NR_9R_{10}$ wherein $R_9$ and $R_{10}$ are independently a hydrogen or a $C_1$ to $C_6$ alkyl group with one $R_9$ and $R_{10}$ pair forming a tertiary amine, X is oxygen or nitrogen, a is an integer from 1 to 10, b is an integer of 0 or 1, and c is an integer from 0 to 10.

12. The quaternary ammonium salt fuel additive of embodiment 10, wherein the quaternizing agent is a diester of a polycarboxylic acid.

13. The quaternary ammonium salt fuel additive of embodiment 12, wherein the quaternizing agent is a diester of oxalic acid, phthalic acid, maleic acid, or malonic acid, or combinations thereof.

14. The quaternary ammonium salt fuel additive of embodiment 10, wherein the quaternizing agent is a halogen substituted derivative of a carboxylic acid.

15. The quaternary ammonium salt fuel additive of embodiment 14, wherein the halogen substituted derivative of a carboxylic acid is a mono-, di-, or tri-chloro-bromo-, fluoro-, or iodo-carboxylic acid, ester, amide, or salt thereof selected from the group consisting of halogen-substituted acetic acid, propanoic acid, butanoic acid, isopropanoic acid, isobutanoic acid, tert-butanoic acid, pentanoic acid, heptanoic acid, octanoic acid, halo-methyl benzoic acid, and isomers, esters, amides, and salts thereof.

16. The quaternary ammonium salt fuel additive of embodiments 14 to 15, wherein the quaternary ammonium salt fuel additive is an internal salt substantially devoid of free anion species.

17. A fuel composition comprising a major amount of fuel and a minor amount of a quaternary ammonium salt having the structure of Formula I;

(Formula I)

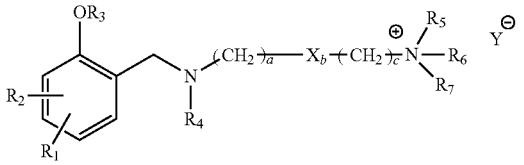

wherein $R_1$ is a hydrocarbyl radical, wherein the number average molecular weight of the hydrocarbyl is about 200 to about 5,000; $R_2$ is hydrogen or $C_1$-$C_6$ alkyl; $R_3$ is hydrogen or, together with $R_4$, a —C(O)— group or a —$CH_2$— group forming a ring structure with the nitrogen atom closest to the aromatic ring; $R_4$ is one of hydrogen, $C_1$-$C_6$ alkyl, —$(CH_2)_a$—$NR_5R_6$, —$(CH_2)_a$-Aryl$R_1R_2OR_3$, or together with $R_3$, a —C(O)— group or a —$CH_2$— group forming a ring structure with the nitrogen atom closest to the aromatic ring; $R_5$ is $C_1$-$C_6$ alkyl or, together with $Y^{\ominus}$, forms a C1-C6 alkyl substituted —C(O)$O^{\ominus}$; $R_6$ and $R_7$, independently, are $C_1$-$C_6$ alkyl; a is an integer from 1 to 10, b is an integer selected from either 0 or 1, and c is an integer from 0 to 10; X is oxygen or nitrogen; and $Y^{\ominus}$ is an anionic group having a structure $R_8C(O)O^{\ominus}$ wherein $R_8$ is one of (i) together with $R_5$ a $C_1$-$C_6$ alkyl group or (ii) a $C_1$-$C_6$ alkyl, an aryl, a $C_1$-$C_4$ alklylene-C(O)O—$R_2$ or a —C(O)O—$R_2$ group.

18. The fuel composition of embodiment 17, wherein $R_1$ is a hydrocarbyl radical derived from a polyisobutylene polymer or oligomer, the number average molecular weight being about 500 to about 1,500, $R_2$ is hydrogen or a methyl group, $R_3$ and $R_4$ are each hydrogen; a is an integer from 1 to 4, and b and c are each 0.

19. The fuel composition of embodiment 18, wherein $R_5$, $R_6$, and $R_7$ are each $C_1$-$C_6$ alkyl and wherein $Y^{\ominus}$ is the anionic group having the structure $R_8C(O)O^{\ominus}$ with $R_8$ being the $C_1$-$C_6$ alkyl, an aryl, a $C_1$-$C_4$ alklylene-C(O)O—$R_2$ or a —C(O)O—$R_2$ group.

20. The fuel composition of embodiment 17, wherein $R_1$ is a hydrocarbyl radical derived from a polyisobutylene polymer or oligomer, the number average molecular weight being about 500 to about 1,500, $R_2$ is hydrogen or a methyl group; $R_3$ together with $R_4$ is the —C(O)— group or the —$CH_2$— group forming a ring structure with the nitrogen atom closest to the aromatic ring; a is an integer from 1 to 4, b and c are each 0.

21. The fuel composition of embodiment 20, wherein and $R_5$, $R_6$, and $R_7$ are each $C_1$-$C_6$ alkyl and wherein $Y^{\ominus}$ is the anionic group having the structure $R_8C(O)O^{\ominus}$ with $R_8$ being the $C_1$-$C_6$ alkyl, an aryl, a $C_1$-$C_4$ alklylene-C(O)O—$R_2$ or a —C(O)O—$R_2$ group.

22. The fuel composition of embodiment 17, wherein $R_1$ is a hydrocarbyl radical derived from a polyisobutylene polymer or oligomer, the number average molecular weight being about 500 to about 1,500, $R_2$ is hydrogen or a methyl group, $R_3$ is hydrogen, $R_4$ is the $C_1$-$C_6$ alkyl group, the —$(CH_2)_a$—$NR_5R_6$ group, or the —$(CH_2)_a$-Aryl$R_1R_2OR_3$ group, a is an integer from 1 to 4, b and c are each 0.

23. The fuel composition of embodiment 22, wherein and $R_5$, $R_6$, and $R_7$ are each $C_1$-$C_6$ alkyl and wherein $Y^{\ominus}$ is the anionic group having the structure $R_8C(O)O^{\ominus}$ with $R_8$ being the $C_1$-$C_6$ alkyl, an aryl, a $C_1$-$C_4$ alklylene-C(O)O—$R_2$ or a —C(O)O—$R_2$ group.

24. The fuel composition of embodiment 17, wherein $R_1$ is a hydrocarbyl radical derived from a polyisobutylene polymer or oligomer, the number average molecular weight being about 500 to about 1,500, $R_2$ is hydrogen or a methyl group, $R_3$ and $R_4$ are each hydrogen; a is an integer from 1 to 4, b is 1, c is an integer from 1 to 4, and X is nitrogen or oxygen.

25. The fuel composition of embodiment 24, wherein and $R_5$, $R_6$, and $R_7$ are each $C_1$-$C_6$ alkyl and wherein $Y^{\ominus}$ is the anionic group having the structure $R_8C(O)O^{\ominus}$ with $R_8$ being the $C_1$-$C_6$ alkyl, an aryl, a $C_1$-$C_4$ alklylene-C(O)O—$R_2$ or a —C(O)O—$R_2$ group.

26. The fuel composition of embodiment 17, wherein the fuel is selected from diesel or gasoline.

27. The fuel composition of embodiment 26, wherein the fuel is diesel and includes about 20 to about 200 ppm of the quaternary ammonium salt.

28. The fuel composition of embodiment 26, wherein the fuel is gasoline and includes about 5 to about 20 ppm of the quaternary ammonium salt.

29. The fuel composition of embodiment 17, wherein the quaternary ammonium salt is derived from (i) a Mannich reaction product or derivative thereof having at least one tertiary amino group and prepared from a hydrocarbyl-substituted phenol, cresol, or derivative thereof, an aldehyde, and a hydrocarbyl polyamine providing the tertiary amino group and reacted with (ii) a quaternizing agent selected from the group consisting of a carboxylic or polycarboxylic acid, ester, amide, or salt thereof or halogen substituted derivative thereof.

30. The fuel composition of embodiment 29, wherein the hydrocarbyl polyamine has the structure $R_9R_{10}N$—$[CH_2]_a$—$X_b$—$[CH_2]_c$—$NR_9R_{10}$ wherein $R_9$ and $R_{10}$ are independently a hydrogen or a $C_1$ to $C_6$ alkyl group with one $R_9$ and $R_{10}$ pair forming a tertiary amine, X is oxygen or nitrogen, a is an integer from 1 to 10, b is an integer of 0 or 1, and c is an integer from 0 to 10.

31. The fuel composition of embodiment 29, wherein the quaternizing agent is a diester of a polycarboxylic acid.

32. The fuel composition of embodiment 29, wherein the quaternizing agent is a diester of oxalic acid, phthalic acid, maleic acid, or malonic acid, or combinations thereof.

33. The fuel composition of embodiment 29, wherein the quaternizing agent is a halogen substituted derivative of a carboxylic acid.

34. The fuel composition of embodiment 33, wherein the halogen substituted derivative of a carboxylic acid is a mono-, di-, or tri-chloro-bromo-, fluoro-, or iodo-carboxylic acid, ester, amide, or salt thereof selected from the group consisting of halogen-substituted acetic acid, propanoic acid, butanoic acid, isopropanoic acid, isobutanoic acid, tert-butanoic acid, pentanoic acid, heptanoic acid, octanoic acid, halo-methyl benzoic acid, and isomers, esters, amides, and salts thereof.

35. The fuel composition of embodiments 33 to 34, wherein the quaternary ammonium salt fuel additive is an internal salt substantially devoid of free anion species.

36. The use of any preceding embodiment for providing improved engine performance such as a power recovery of about 5 percent or greater, about 10 percent or greater, or about 40 percent or greater as measured by a CEC F-98-08 test.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A quaternary ammonium salt fuel additive comprising the structure of Formula I (Formula I)

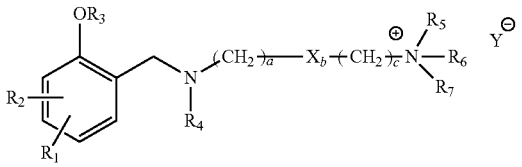

wherein $R_1$ is a hydrocarbyl radical, wherein the number average molecular weight of the hydrocarbyl is about 200 to about 5,000;

$R_2$ is hydrogen or a $C_1$-$C_6$ alkyl group;

$R_3$ is hydrogen or, together with $R_4$, a —C(O)— group or a —$CH_2$— group forming a ring structure with the nitrogen atom closest to the aromatic ring;

$R_4$ is one of hydrogen, $C_1$-$C_6$ alkyl, —$(CH_2)_a$—$NR_5R_6$, —$(CH_2)_a$-Aryl($R_1$)($R_2$)($OR_3$), or together with $R_3$, a —C(O)— group or a —$CH_2$— group forming a ring structure with the nitrogen atom closest to the aromatic ring;

$R_5$ is $C_1$-$C_6$ alkyl or, together with Ye, forms a $C_1$-$C_6$ alkyl substituted —C(O)O⊖;

$R_6$ and $R_7$, independently, are $C_1$-$C_6$ alkyl;

a is an integer from 1 to 10, b is an integer selected from either 0 or 1, and c is an integer from 0 to 10;

X is oxygen or nitrogen; and

Y⊖ is an anionic group having a structure $R_8$C(O)O⊖ wherein $R_8$ is one of (i) together with $R_5$ a $C_1$-$C_6$ alkyl group or (ii) a $C_1$-$C_6$ alkyl, an aryl, a $C_1$-$C_4$ alklylene-C(O)O—$R_2$ or a —C(O)O—$R_2$ group.

2. The quaternary ammonium salt fuel additive of claim 1, wherein $R_1$ is a hydrocarbyl radical derived from a polyisobutylene polymer or oligomer, the number average molecular weight being about 500 to about 1,500, $R_2$ is hydrogen or a methyl group, $R_3$ and $R_4$ are each hydrogen; a is an integer from 1 to 4, and b and c are each 0.

3. The quaternary ammonium salt fuel additive of claim 2, wherein $R_5$, $R_6$, and $R_7$ are each $C_1$-$C_6$ alkyl and wherein Y⊖ is the anionic group having the structure $R_8$C(O)O ⊖ with $R_8$ being the $C_1$-$C_6$ alkyl, an aryl, a $C_1$-$C_4$ alklylene-C(O)O—$R_2$ or a —C(O)O—$R_2$ group.

4. The quaternary ammonium salt fuel additive of claim 1, wherein $R_1$ is a hydrocarbyl radical derived from a polyisobutylene polymer or oligomer; $R_2$ is hydrogen or a methyl group, the number average molecular weight being about 500 to about 1,500, $R_3$ together with $R_4$ is the —C(O)— group or the —$CH_2$— group forming a ring structure with the nitrogen atom closest to the aromatic ring; a is an integer from 1 to 4, b and c are each 0.

5. The quaternary ammonium salt fuel additive of claim 4, wherein and $R_5$, $R_6$, and $R_7$ are each $C_1$-$C_6$ alkyl and wherein Y⊖ is the anionic group having the structure $R_8$C(O)O⊖ with $R_8$ being the $C_1$-$C_6$ alkyl, an aryl, a $C_1$-$C_4$ alklylene-C(O)O—$R_2$ or a —C(O)O—$R_2$ group.

6. The quaternary ammonium salt fuel additive of claim 1, wherein $R_1$ is a hydrocarbyl radical derived from a polyisobutylene polymer or oligomer, the number average molecular weight being about 500 to about 1,500, $R_2$ is hydrogen or a methyl group, $R_3$ is hydrogen, $R_4$ is the $C_1$-$C_6$ alkyl group, the —$(CH_2)_a$—$NR_5R_6$ group, or the —$(CH_2)_a$-Aryl$R_1R_2OR_3$ group, a is an integer from 1 to 4, b and c are each 0.

7. The quaternary ammonium salt fuel additive of claim 6, wherein and $R_5$, $R_6$, and $R_7$ are each $C_1$-$C_6$ alkyl and wherein Y⊖ is the anionic group having the structure $R_8$C(O)O⊖ with $R_8$ being the $C_1$-$C_6$ alkyl, an aryl, a $C_1$-$C_4$ alklylene-C(O)O—$R_2$ or a —C(O)O—$R_2$ group.

8. The quaternary ammonium salt fuel additive of claim 1, wherein $R_1$ is a hydrocarbyl radical derived from a polyisobutylene polymer or oligomer, the number average molecular weight being about 500 to about 1,500, $R_2$ is hydrogen or a methyl group, $R_3$ and $R_4$ are each hydrogen; a is an integer from 1 to 4, b is 1, c is an integer from 1 to 4, and X is nitrogen or oxygen.

9. The quaternary ammonium salt fuel additive of claim 8, wherein and $R_5$, $R_6$, and $R_7$ are each $C_1$-$C_6$ alkyl and wherein Y⊖ is the anionic group having the structure $R_8$C(O)O⊖ with $R_8$ being the $C_1$-$C_6$ alkyl, an aryl, a $C_1$-$C_4$ alklylene-C(O)O—$R_2$ or a —C(O)O—$R_2$ group.

10. The quaternary ammonium salt fuel additive of claim 1, wherein the quaternary ammonium salt fuel additive is derived from (i) a Mannich reaction product or derivative thereof having at least one tertiary amino group and prepared from a hydrocarbyl-substituted phenol, cresol, or derivative thereof, an aldehyde, and a hydrocarbyl polyamine providing the tertiary amino group and reacted with (ii) a quaternizing agent selected from the group consisting of a carboxylic or polycarboxylic acid, ester, amide, or salt thereof or halogen substituted derivative thereof.

11. The quaternary ammonium salt fuel additive of claim 10, wherein the hydrocarbyl polyamine has the structure $R_9R_{10}N$—$[CH_2]_a$—$X_b$—$[CH_2]_c$—$NR_9R_{10}$ wherein $R_9$ and $R_{10}$ are independently a hydrogen or a $C_1$ to $C_6$ alkyl group with one $R_9$ and $R_{10}$ pair forming a tertiary amine, X is oxygen or nitrogen, a is an integer from 1 to 10, b is an integer of 0 or 1, and c is an integer from 0 to 10.

12. The quaternary ammonium salt fuel additive of claim 10, wherein the quaternizing agent is a diester of a polycarboxylic acid.

13. The quaternary ammonium salt fuel additive of claim 12, wherein the quaternizing agent is a diester of oxalic acid, phthalic acid, maleic acid, or malonic acid, or combinations thereof.

14. The quaternary ammonium salt fuel additive of claim 10, wherein the quaternizing agent is a halogen substituted derivative of a carboxylic acid.

15. The quaternary ammonium salt fuel additive of claim 14, wherein the halogen substituted derivative of a carboxylic acid is a mono-, di-, or tri- chloro- bromo-, fluoro-, or iodo-carboxylic acid, ester, amide, or salt thereof selected from the group consisting of halogen-substituted acetic acid, propanoic acid, butanoic acid, isopropanoic acid, isobutanoic acid, tert-butanoic acid, pentanoic acid, heptanoic acid, octanoic acid, halo-methyl benzoic acid, and isomers, esters, amides, and salts thereof.

16. The quaternary ammonium salt fuel additive of claim 15, wherein the quaternary ammonium salt fuel additive is an internal salt substantially devoid of free anion species.

17. A fuel composition comprising a major amount of fuel and a minor amount of a quaternary ammonium salt having the structure of Formula I (Formula I)

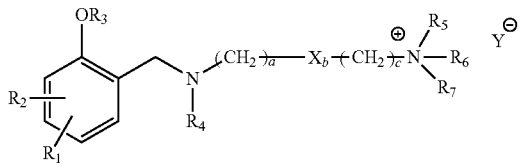

wherein $R_1$ is a hydrocarbyl radical, wherein the number average molecular weight of the hydrocarbyl is about 200 to about 5,000;

$R_2$ is hydrogen or $C_1$-$C_6$ alkyl;

$R_3$ is hydrogen or, together with $R_4$, a —C(O)— group or a —$CH_2$— group forming a ring structure with the nitrogen atom closest to the aromatic ring;

$R_4$ is one of hydrogen, $C_1$-$C_6$ alkyl, —$(CH_2)_a$—$NR_5R_6$, —$(CH_2)_a$-Aryl$R_1R_2OR_3$, or together with $R_3$, a —C(O)— group or a —$CH_2$— group forming a ring structure with the nitrogen atom closest to the aromatic ring;

$R_5$ is $C_1$-$C_6$ alkyl or, together with Y⊖, forms a $C_1$-$C_6$ alkyl substituted —C(O)O⊖;

$R_6$ and $R_7$, independently, are $C_1$-$C_6$ alkyl;

a is an integer from 1 to 10, b is an integer selected from either 0 or 1, and c is an integer from 0 to 10;

X is oxygen or nitrogen; and

Y⊖ is an anionic group having a structure $R_8C(O)O^{\ominus}$ wherein $R_8$ is one of (i) together with $R_5$ a $C_1$-$C_6$ alkyl group or (ii) a $C_1$-$C_6$ alkyl, an aryl, a $C_1$-$C_4$ alklylene-C(O)O—$R_2$ or a —C(O)O—$R_2$ group.

18. The fuel composition of claim 17, wherein $R_1$ is a hydrocarbyl radical derived from a polyisobutylene polymer or oligomer, the number average molecular weight being about 500 to about 1,500, $R_2$ is hydrogen or a methyl group, $R_3$ and $R_4$ are each hydrogen; a is an integer from 1 to 4, and b and c are each 0.

19. The fuel composition of claim 18, wherein $R_5$, $R_6$, and $R_7$ are each $C_1$-$C_6$ alkyl and wherein Y⊖ is the anionic group having the structure $R_8C(O)O^{\ominus}$ with $R_8$ being the $C_1$-$C_6$ alkyl, an aryl, a $C_1$-$C_4$ alklylene-C(O)O—$R_2$ or a —C(O)O—$R_2$ group.

20. The fuel composition of claim 17, wherein the fuel is diesel and includes about 20 to about 200 ppm of the quaternary ammonium salt or wherein the fuel is gasoline and includes about 5 to about 20 ppm of the quaternary ammonium salt.

* * * * *